US007123141B2

(12) United States Patent
Contestabile

(10) Patent No.: US 7,123,141 B2
(45) Date of Patent: Oct. 17, 2006

(54) ELECTRONIC MONITORING SYSTEMS AND METHODS

(76) Inventor: Robert A. Contestabile, 4 Shire, Coto de Caza, CA (US) 92679

( * ) Notice: Subject to any disclaimer, the term of this patent is extended or adjusted under 35 U.S.C. 154(b) by 106 days.

(21) Appl. No.: 10/644,606

(22) Filed: Aug. 20, 2003

(65) Prior Publication Data

US 2005/0040944 A1 Feb. 24, 2005

(51) Int. Cl.
*G08B 1/08* (2006.01)

(52) U.S. Cl. ..... 340/539.13; 340/539.1; 340/539.14; 340/539.15; 340/572.1; 340/573.1; 340/573.4

(58) Field of Classification Search ..... 340/539.13, 340/539.1, 539.14, 539.15, 572.1, 573.1, 340/573.4

See application file for complete search history.

(56) References Cited

U.S. PATENT DOCUMENTS

| | | | | |
|---|---|---|---|---|
| 5,266,944 | A | 11/1993 | Carroll et al. | 340/825.36 |
| 5,396,227 | A | 3/1995 | Carroll et al. | 340/825.36 |
| 5,731,757 | A | 3/1998 | Layson, Jr. | 340/573.1 |
| 5,889,474 | A | 3/1999 | Ladue | 340/825.49 |
| 5,892,454 | A * | 4/1999 | Schipper et al. | 340/825.37 |
| 6,014,080 | A | 1/2000 | Layson, Jr. | 340/573.1 |
| 6,100,806 | A * | 8/2000 | Gaukel | 340/573.4 |
| 6,225,906 | B1 * | 5/2001 | Shore | 340/573.4 |
| 6,239,700 | B1 * | 5/2001 | Hoffman et al. | 340/539.13 |
| 6,362,778 | B1 * | 3/2002 | Neher | 342/357.07 |
| 6,703,936 | B1 * | 3/2004 | Hill et al. | 340/573.4 |
| 6,744,799 | B1 * | 6/2004 | Takase | 372/46 |
| 6,838,998 | B1 * | 1/2005 | Brown et al. | 340/825.49 |

* cited by examiner

*Primary Examiner*—Daryl C Pope
(74) *Attorney, Agent, or Firm*—Kenneth W. Float

(57) ABSTRACT

Electronic monitoring systems and methods that permit full-time tracking and management of, and communication with, monitored clients that carry a client tracking unit and wear a transmitter, by a monitoring individual that carries a wireless portable monitoring device. A central monitoring station having a central database is ported to a plurality of processor interfaces, including RF, GPS, and integrated voice, for example. The central database is wirelessly linked to the portable monitoring device, which is programmed to remotely track and manage clients by way of the respective interfaces. A monitoring unit is coupled to (or includes) a dock that docks the client tracking unit. The client tracking unit has a GPS receiver that receives position signals from satellites orbiting the Earth to permit tracking of the client. The client tracking unit has a battery that houses a receiver that receives signals transmitted by the transmitter and monitors transmitted signals to determine if an alarm event has occurred relating to the transmitter or location of the client. The portable monitoring device has cellular and web browser capabilities that provide access to the central monitoring station by way of a network, and permits retrieval and changing of information by the monitoring individual regarding monitored clients. Information regarding specific clients or a group of clients may be retrieved (optionally using voice commands) from the central monitoring station, modified by the monitoring individual, or selected clients may be directly communicated with using the voice capabilities of the portable monitoring device and client tracking unit.

42 Claims, 14 Drawing Sheets

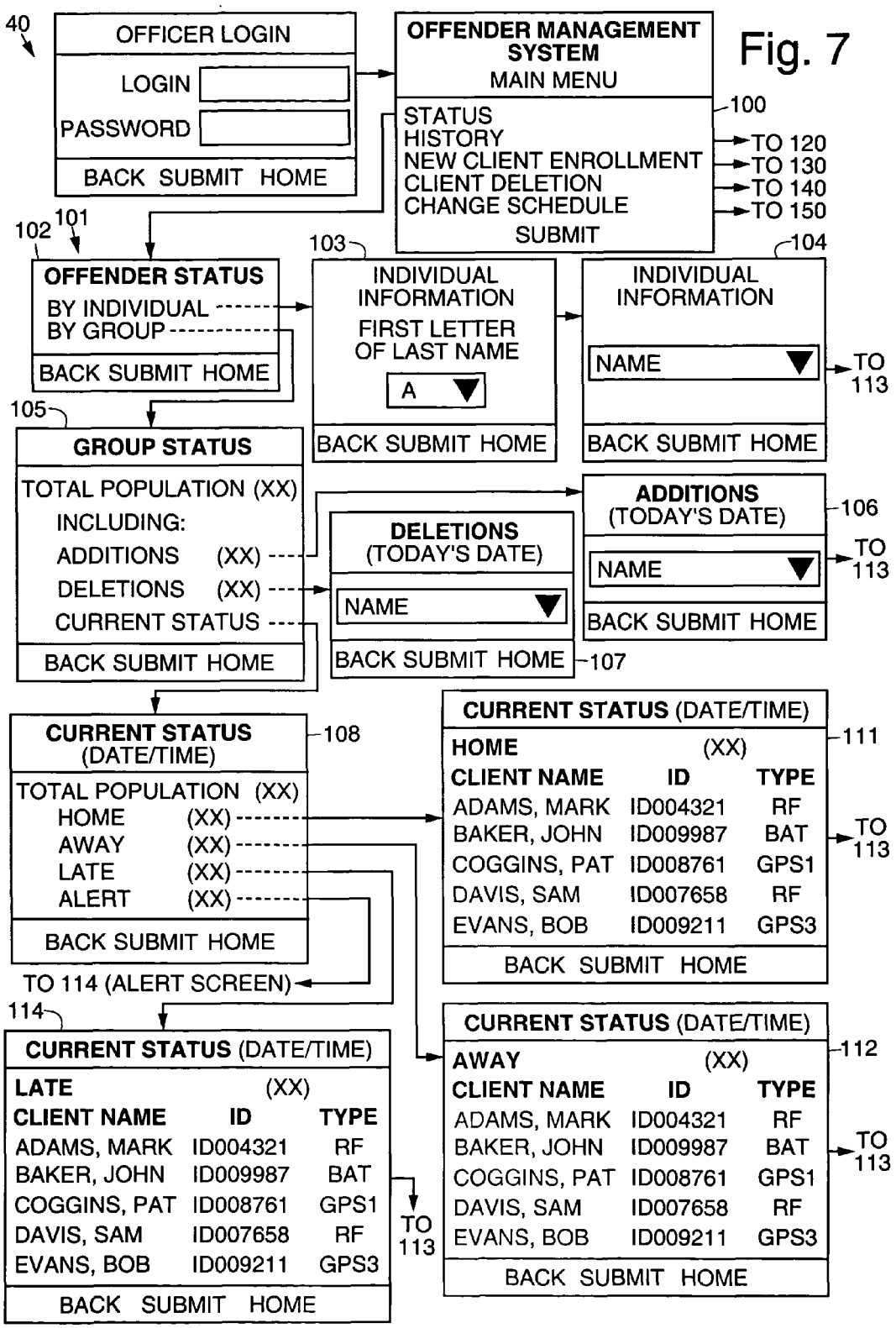
Fig. 7
40
OFFICER LOGIN
LOGIN
PASSWORD
BACK SUBMIT HOME
OFFENDER MANAGEMENT SYSTEM
MAIN MENU
STATUS
HISTORY
NEW CLIENT ENROLLMENT
CLIENT DELETION
CHANGE SCHEDULE
SUBMIT
100
TO 120
TO 130
TO 140
TO 150
102
101
OFFENDER STATUS
BY INDIVIDUAL
BY GROUP
BACK SUBMIT HOME
103
INDIVIDUAL INFORMATION
FIRST LETTER OF LAST NAME
A
BACK SUBMIT HOME
104
INDIVIDUAL INFORMATION
NAME
TO 113
BACK SUBMIT HOME
105
GROUP STATUS
TOTAL POPULATION (XX)
INCLUDING:
ADDITIONS (XX)
DELETIONS (XX)
CURRENT STATUS
BACK SUBMIT HOME
DELETIONS (TODAY'S DATE)
NAME
BACK SUBMIT HOME
107
ADDITIONS (TODAY'S DATE)
106
NAME
TO 113
BACK SUBMIT HOME
CURRENT STATUS (DATE/TIME)
108
TOTAL POPULATION (XX)
HOME (XX)
AWAY (XX)
LATE (XX)
ALERT (XX)
BACK SUBMIT HOME
TO 114 (ALERT SCREEN)
CURRENT STATUS (DATE/TIME)
HOME (XX)
CLIENT NAME ID TYPE
ADAMS, MARK ID004321 RF
BAKER, JOHN ID009987 BAT
COGGINS, PAT ID008761 GPS1
DAVIS, SAM ID007658 RF
EVANS, BOB ID009211 GPS3
BACK SUBMIT HOME
111
TO 113
114
CURRENT STATUS (DATE/TIME)
LATE (XX)
CLIENT NAME ID TYPE
ADAMS, MARK ID004321 RF
BAKER, JOHN ID009987 BAT
COGGINS, PAT ID008761 GPS1
DAVIS, SAM ID007658 RF
EVANS, BOB ID009211 GPS3
BACK SUBMIT HOME
TO 113
CURRENT STATUS (DATE/TIME)
AWAY (XX)
CLIENT NAME ID TYPE
ADAMS, MARK ID004321 RF
BAKER, JOHN ID009987 BAT
COGGINS, PAT ID008761 GPS1
DAVIS, SAM ID007658 RF
EVANS, BOB ID009211 GPS3
BACK SUBMIT HOME
112
TO 113

| ALARM | XMTR ID | DATE | TIME | TAMPER | SEVER | LOW BATT | SSI | CHNL |
|---|---|---|---|---|---|---|---|---|
| YES | 17803 | 07/26/03 | 19:21:02 | NO | YES | NO | 205 | B |
| NO | 17204 | 07/26/03 | 19:20:32 | NO | NO | NO | 165 | A |
| YES | 17765 | 07/26/03 | 19:20:13 | YES | NO | YES | 125 | B |
| YES | 17524 | 07/26/03 | 19:19:51 | NO | NO | YES | 168 | A |
| NO | 17204 | 07/26/03 | 19:19:01 | NO | NO | NO | 186 | A |
| NO | 17756 | 07/26/03 | 19:15:51 | NO | NO | NO | 134 | B |
| NO | 17390 | 07/26/03 | 19:11:43 | NO | NO | NO | 220 | A |
| YES | 17765 | 07/26/03 | 19:11:07 | YES | NO | YES | 143 | B |

ZoomIn ZoomOut

Date:08/13/2003 Time:03:57:54 PM

Direction:201 T Speed:029 mph

Address: 4481 Roswell Rd Ne City: ATLANTA State: GA

Back Home

ELECTRONIC MONITORING SYSTEMS AND METHODS

TECHNICAL FIELD

The present invention relates to electronic monitoring systems and methods, and more particularly to improved systems and methods employing global position system tracking, dual frequency transmitters and receivers, and wireless monitoring devices that permit monitoring and communication with monitored individuals.

The present invention is particularly adapted for use in monitoring offenders who are required to wear the transmitters. However, the present invention may also be used to track and/or monitor other individuals such as children, for example, as well as track and/or monitor movable physical entities, such as cars, trucks, train boxcars, or shipments to which a transmitter can be attached.

BACKGROUND

Offender monitoring is an important aspect of law enforcement. Certain offenders that are placed on house arrest, or that require electronic monitoring, are often fitted with a transponder or transmitter (ankle bracelet) that must be worn at all times. Such transponders or transmitter have evolved over the years and can be manufactured to include tracking capabilities employing global position system tracking using orbiting satellites.

For example, U.S. Pat. No. 5,731,757 issued to Layson, Jr. discloses a "portable locator or tracking apparatus is provided for continuous location determination of subjects which communicates with a body-worn, non-removable, tamper resistant transceiver and a central data-base system. The portable tracking apparatus has a Global Position System (GPS) receiver and inertial sensors for determining location, microprocessors for logic and mathematical algorithm processing, memory for programs and data, a wireless transceiver for communications with the body-worn device, a wireless transceiver for communicating with the central data-base system, an alpha-numeric display for displaying text messages sent to the subject acoustic speaker and microphone for voice and tone messages with subjects, electronic tamper sensors, motion sensors, attitude position sensor, batteries and external connectors for power, recharge, communications and auxiliary antennas." However, the portable tracking apparatus is relatively large and cumbersome, and weighs on the order of several pounds.

U.S. Pat. No. 6,014,080 issued to Layson, Jr. discloses a "Tamper resistant body-worn tracking device to be worn by offenders or potential victims for use in a wireless communication system receiving signals from a global positioning system (GPS). The tracking device directly communicates spacial coordinates to multiple remote sites. The tracking device is an enclosed case worn on a limb of a person. The case contains a battery, a signaling device, and a circuit board containing a field programmable gate array, a wireless data modem, a conventional GPS receiver, and a matched filtering GPS receiver." This system employs wireless data modems to transmit offender location data to a central database.

Also, in this system, a cellular network is used to provide communication between an offender's body-worn tracking device and a cell phone carried by the offender. For example, it is stated in U.S. Pat. No. 6,014,080 that "The mobile switching office uses wireless communications 132, 134, 136, 140, 148, 150 through a network cell site 124 to provide communications between the offender's body-worn tracking device 10 and wireless personal communication service (PCS) notification devices such as digital cellular phones 144, mobile data terminals 142 and digital alphanumeric pagers 146." Thus, in this system, there is no direct communication between the transponder and the cell phone carried by the offender. Thus type of cellular communication between an offender's body-worn tracking device and a cell phone carried by the offender is also disclosed in U.S. Pat. No. 5,982,281 issued to Layson, Jr.

U.S. Pat. No. 5,889,474 issued to Ladue discloses a "method and apparatus of transmitting subject status information, such as the status and location of a parolee or individual under house arrest, to a central monitoring station (CMS) operated by, for example, a parole staff or correctional facility. The subject status information is transmitted by a band or collar attached to, for example, the leg or wrist of the subject. A cellular radio communicator receives, encodes and transmits the subject status information over the control channel of a cellular radio communications network as control signals, bypassing the voice channels, to a mobile switching center (MSC) of the cellular radio communications network. The MSC decodes and forwards the subject status information over the public switched telephone network (PSTN) to the CMS. Optionally, the CMS may send a command to the communicator over the same data paths, i.e., the PSTN to the MSC, then over the control channel, formatted as a control signal, to the cellular radio communications network communicator. The communicator may integrate a paging receiver, or a satellite receiver, or other wireless receiver for receiving commands out of band, i.e., by way of communication networks other than the cellular radio communications network. The method and apparatus may also be utilized to track to position of more than one subject relative to other subjects or objects."

U.S. Pat. No. 6,100,806 issued to Gaukel discloses an "apparatus and method of monitoring mobile objects or persons utilizes the Global Positioning System satellites and cellular telephone communications. The apparatus may include first and second remote units adapted to be worn on the monitored person or object. These remote units would comprise the position and data sensors as well as the transmitter device to transmit the information back to a central tracking station. The remote units may be operative to monitor many data items such as system integrity, motion, temperature, audio, and the like in addition to position. This data would then be transmitted back to a central monitoring station operative to process and display the information. The system is also adapted to monitor persons in hazardous environments such as radioactivity or poisonous gases or even to monitor inanimate objects such as automobiles."

U.S. Pat. Nos. 5,266,944 and 5,396,227 issued to Carroll, et al. essentially disclose "electronic monitoring systems" that "monitor an individual for compliance with a protective order." In these systems, a cellular telephone may be incorporated in a receiving/monitoring device that monitors a transmitter tag worn by the individual, and transmits an ID signal associated with the transmitter to a central monitoring location. However, the systems disclosed in these patents do not use global positioning system capabilities.

However, none of the above-cited patents disclose or suggest the use of a transmitter worn by an individual (offender) that directly communicates with a cellular communication device (cellular telephone) carried by the individual. None of the above-cited patents disclose or suggest the use of a transmitter that employs the use of dual frequencies to communicate with a cellular telephone (or similar communication device) carried by the individual. None of the above-cited patents disclose or suggest the use of a wireless portable monitoring device, such as a personal digital assistant (PDA) or pocket personal computer (PC), for example, that incorporates cellular telephone and web browser capabilities that permits voice communication between a person that is tasked with monitoring an individual and the individual that carries a cellular telephone. None of the above-cited patents disclose or suggest the use of a wireless portable monitoring device, such as a personal digital assistant (PDA) or pocket personal computer (PC), that incorporates a cellular telephone and web browser capabilities that permits voice-activated and web-based tracking of one or more individuals by a monitoring individual. Furthermore, none of the above-cited patents disclose or suggest the use of an offender management system having a central computer that is ported to a plurality of software interfaces, including RF, GPS and integrated voice recognition, and that employs a wireless portable monitoring device that is used by a monitoring individual that has the ability to interface to and remotely manage monitored individuals by way of the respective interfaces.

In addition, conventional transmitters have been designed in a manner that limits their usefulness and effectiveness. For example, no conventional transmitter has operated using more than one frequency. Conventional transmitters are relatively unhealthy, in that the back of the transmitter contacts the skin of an offender or client, and is later reused for subsequent offenders or clients. No conventional transmitter has been designed to have a two-piece design that allows the portion of the transmitter that comes in direct contact with the skin of a client's ankle to be discarded after each client completes the monitoring term, thus improving the hygienic conditions for the client and installer. No conventional transmitter has been designed to be "installed" on an offender or client without using rails, screws, clamps or latches or similar device.

Also, conventional electronic monitoring systems use only single frequency receivers in home monitoring units. The tracking range of the receiver relative to the transmitter is thus limited to one distance, which is typically designed for "away from home" applications. As a result, there are limitations on monitoring the client, when he or she is at home.

No conventional electronic monitoring system has a home monitoring unit receiver that provides for substantially simultaneous redundant dual frequency signal recognition and reception. While conventional monitoring system download data to a central monitoring station, no conventional monitoring system has heretofore provided for a cellular telephone (tracking unit) carried by a client or offender to download client location data to a central monitoring station via a land line attached to a home monitoring unit, and in addition, download client location data using GSM/SMS messaging in the event of a land line failure.

No conventional electronic monitoring system has employed an offender (client) tracking unit that provides for GPS tracking, wireless voice and data receipt and relay, text message display, RF connection to an ankle transmitter, or docked connection to a home monitoring unit, along with software intelligence and memory capabilities that permit such capabilities.

No conventional electronic monitoring system has employed a docking station that (1) interfaces a home monitoring unit to a client (offender) tracking unit, (2) charges the client tracking unit from the home monitoring unit, (3) provides serial connection to the home monitoring unit for land line download of client location and event data, (4) allows the home monitoring unit to utilize the client tracking unit for wireless download of RF information in the event of home monitoring unit land line loss, or (5) disables the RF receiver of the client tracking unit when it is docked.

No conventional electronic monitoring system has a monitoring center that uses multiple offender tracking technologies monitored on a 24 hours, 7 days a week basis with output combined using a web server and presented to a person tasked with monitoring individuals by way of multiple devices, including PDA, cell phone, fax, email and the like. More specifically, no conventional electronic monitoring system provides for the use of integrated voice response technology, radio frequency ankle bracelet technology, and multiple-level GPS technology delivered to a PDA (offender monitoring device) that displays status of an entire offender population regardless of applied monitoring technology.

No conventional electronic monitoring system employs a client monitoring device (PDA) that provides for (1) direct, real time, wireless voice and data access to both the offender and the monitoring center, (2) alerts a monitoring individual (officer) directly from the offender tracking unit (GPS) and RF units using wireless technology, in real time, (3) allows placement and receipt of calls directly between the monitoring center and offender and the monitoring individual (officer) and offender, or that sends and receives data transmissions via a wireless connection. More specifically, no conventional electronic monitoring system uses a client monitoring device (PDA) that allows the monitoring individual (officer) to change the schedule of an client, view client activity, view offender violation history, locate clients (GPS clients), call the client, or view the status of a client.

Conventional electronic monitoring systems have included victim awareness units that only alert a victim of the presence or absence of an offender within a pre-loaded or pre-specified zone. The victim however, may inadvertently come in contact with an offender while performing daily routines such as banking, grocery shopping, or errands, for example. However, no conventional electronic monitoring system has, in a domestic violence application, employed an offender monitoring device (PDA) for use by a victim that allows the victim to locate the offender's location in real time to reduce or preclude unintended collateral contact. Furthermore, no conventional electronic monitoring system has employed an offender monitoring device (PDA) for use by a victim that allows the victim to have data and voice contact with the monitoring center to gain assistance or to a monitoring individual (officer) if permitted by agency requirements.

Accordingly, it would be advantageous to have electronic monitoring systems and methods that improve upon the capabilities of conventional systems and methods.

SUMMARY OF THE INVENTION

The present invention provides for improved electronic monitoring systems and methods that permit full-time tracking of, and communication between, monitored clients (or offenders) that carry a wireless communication device, such as a cellular telephone (or similar communication device) and a transmitter, and a person that is responsible for monitoring the clients (a monitoring individual or law enforcement officer). The present invention provides for many significant improvements over the prior state of the art relating to offender (client) management systems and methods.

In general, an exemplary electronic monitoring system comprises an client (or other individual, offender, or entity) management system having a central monitoring station or central computer that is ported to a plurality of processor interfaces, including RF, GPS and integrated voice recognition processing layers, example, and a wireless link to a wireless portable monitoring device that is used by the monitoring individual that has the ability to interface to and remotely manage clients by way of the respective interfaces.

A monitoring unit is installed at the home of the client is coupled to or includes a dock, a transmitter (ankle bracelet) is worn by the client (or offender), and a client tracking unit comprising a wireless voice and data communication device, such as a GSM (Global System for Mobile communications) cellular telephone, for example, that is carried by the client. The wireless communication device is inserted in the dock so that it is coupled to the monitoring unit when the client is home, which allows the device to recharge and causes the device to GPS download location and status data to the central monitoring station. The monitoring unit communicates with the central monitoring station or computer system (typically over a land communication link or land line) to download the location data regarding the client. The dock allows download of the location and status data to the central monitoring station using the docked client tracking unit by way of a wireless network in the event that land line communication is not possible.

The transmitter is preferably a dual frequency transmitter that transmits identifying information at two separate frequencies separated in time to the monitoring unit when it is located in proximity thereto, and on one, or preferably both, of the frequencies to the client tracking unit when it is carried by the client. The monitoring unit and client tracking unit provide for substantially simultaneous redundant dual frequency signal recognition and reception of the two frequencies.

The transmitter is secured to the client by a strap and includes means for detecting if the strap is severed (i.e., the transmitter is removed from contact with the client or is disabled by the client), or if the client tracking unit and transmitter are not substantially collocated. The transmitter may be configured or programmed to transmit alert signals to the wireless communication device immediately if the transmitter is tampered with, based upon customer-defined criteria. In addition, unresolved alert signals may be transmitted to the monitoring individual, and resolved alert signals may be transmitted to the central monitoring station for reporting to the monitoring individual. The transmitter is preferably a two-piece transmitter that requires no tools for installation and allows the portion of the transmitter that comes in direct contact with the skin of the client to be discarded after completion of the monitoring term, thus improving the hygienic conditions for the client and installer.

The client tracking unit comprises a wireless voice and data communication device such as a global positioning system (GPS) and GSM capable device, that receives position signals from satellites orbiting the Earth. The GPS capabilities of the wireless communication device permit tracking of the client with very high accuracy. The client tracking unit is able to download location data to the central monitoring station via a land telephone line attached to the monitoring unit, and download location data using GSM/SMS messaging in the event of a land line failure. The client tracking unit provides for GPS tracking, wireless voice and data receipt and relay, text message display, RF connection to the transmitter, or docked connection to the monitoring unit, along with software intelligence and memory capabilities that permit these capabilities.

The client tracking unit also has a unique battery constructed to house a single or preferably dual frequency receiver that receives signals transmitted by the transmitter. The receiver monitors the signals transmitted by the transmitter to determine if an alarm event has occurred. The client tracking unit transmits status information to the monitoring center by way of the monitoring unit and land telephone lines, or by way of the wireless network, when it is docked.

The client tracking unit preferably incorporates a programmable status check, or heartbeat. Each client tracking unit may be programmed to enable the unit to independently report position, status condition throughout the duration of an undocked and/or away-from-the-home-monitoring-unit condition to the central station. The client tracking unit may be programmed to report at predetermined intervals indicating that communication by way of the wireless network is viable, the client tracking unit is in good condition and has not been disabled or otherwise compromised. This status check, or heartbeat, is especially desirable where the client tracking unit is not required to update position information continuously. A failure, multiple failures or any customer-determined failure of the client tracking unit to report a heartbeat expected by the monitoring software is considered an alarm and is immediately reported to the monitoring individual by way of the wireless portable monitoring device. Use of such intelligent features allows the last position of the client to be read, and the time at which acquisition was lost to be known and presented to the monitoring individual.

The monitoring individual (law enforcement officer, for example) carries the wireless portable monitoring device which incorporates wireless telephone and web browser capabilities. The web browser permits the monitoring individual to access the central monitoring station by way of the wireless network and obtain status information, or change information, regarding those clients he or she is responsible for. Information regarding specific clients or a group of clients may be retrieved from the central monitoring station and imported to the portable monitoring device using GSM capabilities of the portable wireless monitoring device. Furthermore, retrieval of the data during a web browser session with the central monitoring station may be obtained using voice commands. The wireless portable monitoring device thus permits voice-activated and web-based tracking of one or more clients by the monitoring individual, along with direct communication with the monitored client.

The dock (or docking station) interfaces the monitoring unit to the client tracking unit, and permits charging of the client tracking unit by the monitoring unit. The dock provides serial connection to the monitoring unit for land line download of location and event data, allows the monitoring unit to utilize the client tracking unit for wireless download of RF information in the event of land line interruption to the monitoring unit. Docking of the client tracking unit disables the RF receiver of the client tracking unit.

The monitoring center uses multiple client tracking technologies monitored on a 24 hours, 7 days a week basis with output combined using a web server and presented to the monitoring individual by way of multiple devices, including PDA, cell phone, fax, email, or the like. Integrated voice response technology, radio frequency ankle transmitter technology, and multiple-level GPS technology is used to deliver data to the wireless portable monitoring device to display status of an entire population of monitored clients regardless of the monitoring technology that is employed.

The portable monitoring device provides for direct, real time, wireless voice and data access to monitored clients, displays alerts to the monitoring individual directly from the client tracking (GPS) and monitoring units using wireless technology, in real time, and allows placement and receipt of calls directly between the monitoring individual and the client, and sends and receives data transmissions via wireless communication. The portable monitoring device allows the monitoring individual to change the schedule of a client, view client activity, view violation history, locate clients, call clients, enroll and delete clients, or view the status of clients. The use of the portable monitoring device which is wirelessly interfaced to the client tracking unit and central monitoring station provides electronic monitoring capabilities not possible with any conventional electronic monitoring system. A secure login procedure is used to update or change information.

The electronic monitoring system may also be used in a domestic violence application. A version of the wireless portable monitoring device may be used by a victim to monitor and determine an offender's location in real time to reduce or preclude unintended collateral contact. This version of the wireless portable monitoring device allows the victim to have data and voice contact with the monitoring center to gain assistance or with the monitoring individual if permitted by agency requirements.

BRIEF DESCRIPTION OF THE DRAWINGS

The various features and advantages of the present invention may be more readily understood with reference to the following detailed description taken in conjunction with the accompanying drawings, described by way of example, and wherein like reference numerals designate like structural elements, and in which:

FIGS. 7–12 illustrate operations that are performed using the portable monitoring device;

DETAILED DESCRIPTION

Figure 1:
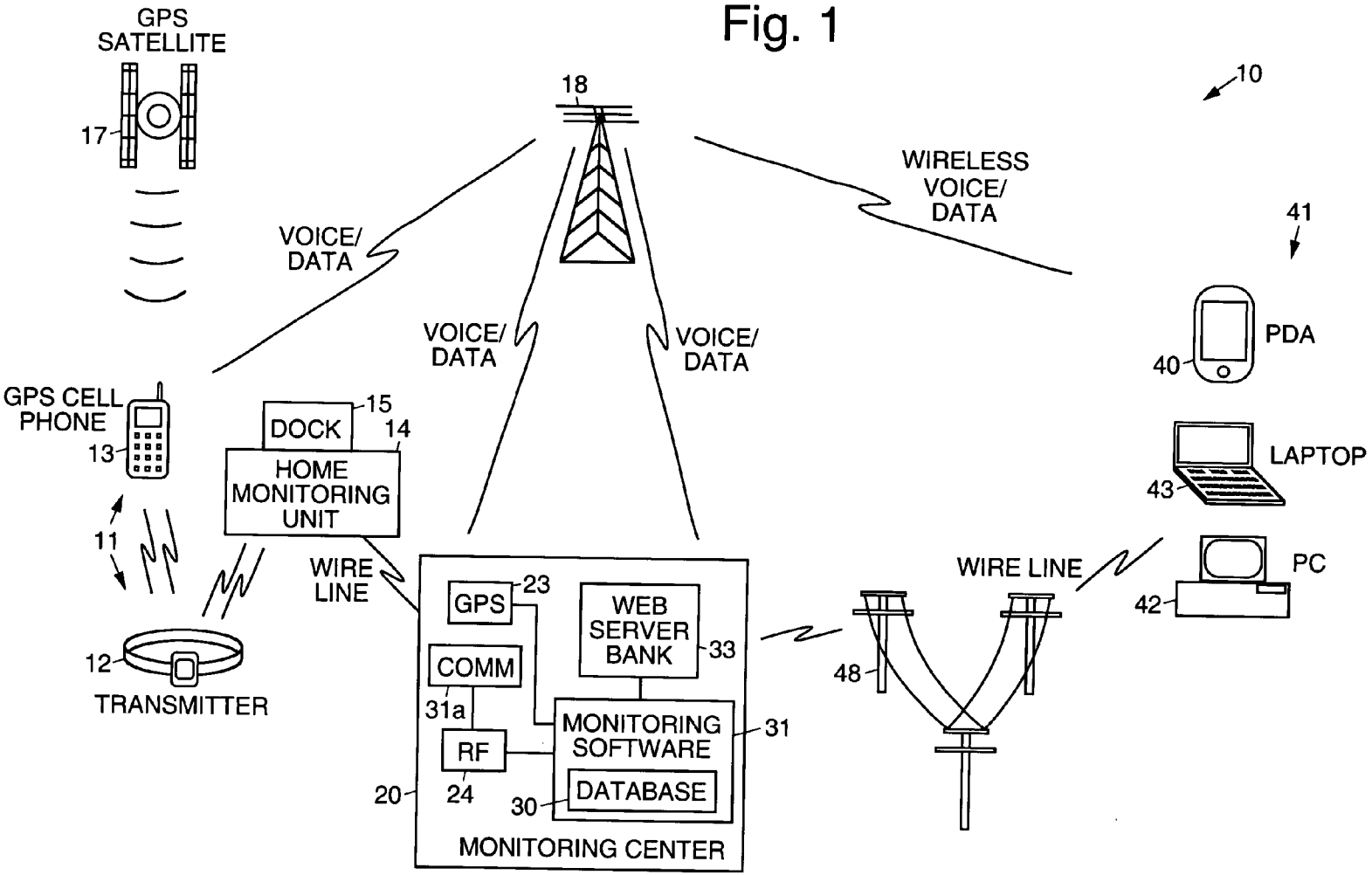
FIG. 1 illustrates the architecture of an exemplary electronic monitoring system in accordance with the principles of the present invention.

Referring to the drawing figures, FIG. 1 illustrates the basic architecture of an exemplary electronic monitoring system 10 in accordance with the principles of the present invention. The exemplary electronic monitoring system 10 is used to monitor one or more clients 11 (such as offenders 11, for example). However, it is to be understood that the electronic monitoring system 10 may also be used to track and/or monitor clients 11 such as children, for example, and track and/or monitor movable physical entities, such as cars, trucks, train boxcars, or shipments to which a transmitter can be attached.

The basic architecture of the electronic monitoring system 10 comprises a central monitoring station 20 or computer system 20 that provides centralized software including communication software 31*a*, and monitoring software 31 including database storage 30 (database 30) containing information relating to monitored clients 11. The central monitoring station 20 includes Global Positioning System (GPS) receivers 23, radio frequency (RF) receivers 24, and web servers 33.

A monitored client 11, such as an offender 11, wears an RF transmitter 12, commonly referred to as an ankle bracelet, and carries a client tracking unit 13. Details of an exemplary RF transmitter 12 are discussed with reference to FIG. 4. A monitoring unit 14 is installed at the client's residence (home). The monitoring unit 14 has or is coupled to a dock 15 that is designed to receive (dock) the client tracking unit 13. The monitoring unit 14 is coupled to a central monitoring station 20, typically by way of a land communication (telephone or wire line) connection.

The client tracking unit 13 receives and stores time-coded geolocation (position) information derived from satellites 17 of the Global Positioning System that indicate the geolocation of the client tracking unit 13. The client tracking unit 13 is thus used to track the position of the client 11 carrying it. The RF transmitter 12 is in communication with the client tracking unit 13 when the client 11 is away from home, and is in communication with the monitoring unit 14 when the client 11 is at home, A person 41 tasked with monitoring the client 11 (a monitoring individual 41) has the ability to communicate with the central monitoring station 20 by way of a personal computer 42 or a laptop computer 43 using wire line connection 48 in a conventional manner. However, in accordance with the present invention, monitoring individual 41 carries the portable monitoring device 40 that provides for wireless communication with the central monitoring station 20, and with the monitored client 11 via the client tracking unit 13.

The portable monitoring device 40 is used by the monitoring individual 41 to remotely track, monitor, supervise and communicate with clients 11 as well as access, review, and change information relating to the monitored clients 11. Details of an exemplary portable monitoring device 40 are discussed with reference to FIG. 5.

Figure 2:
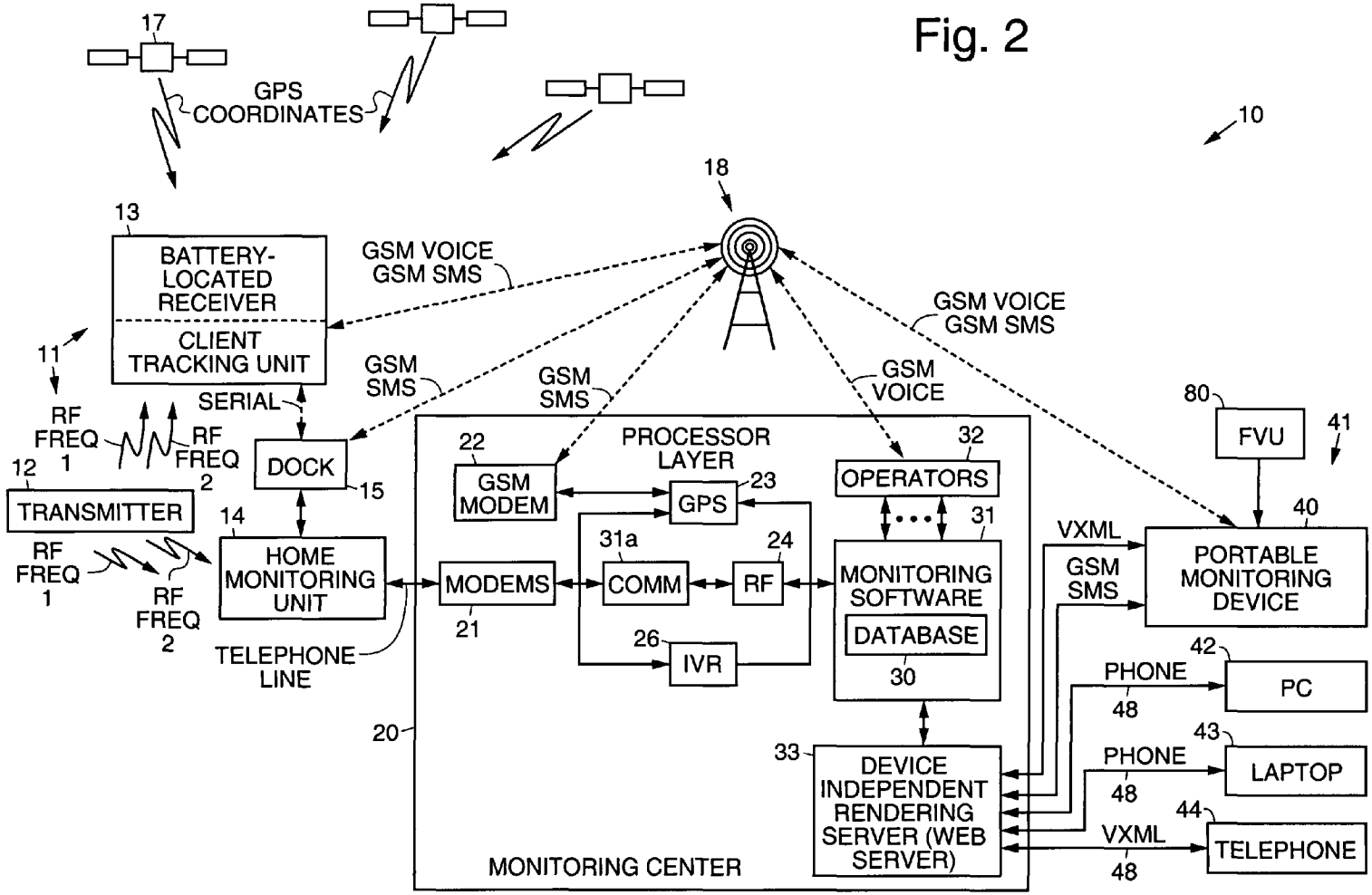
FIG. 2 illustrates details of the architecture of the exemplary electronic monitoring system shown in FIG. 1.

FIG. 2 illustrates details of the exemplary electronic monitoring system 10 shown in FIG. 1. In the exemplary system 10 shown in FIG. 2, the client 11 wears the RF transmitter 12, or ankle bracelet, and carries the client tracking unit 13. The client tracking unit 13 provides for a key aspect of the present invention. The monitoring unit 14 located at the client's residence has or is coupled to the dock 15 that receives the client tracking unit 13 when the client 11 is home.

The client tracking unit 13 wirelessly communicates by way of a wireless communication network 18 (such as a cellular network, for example) with the central monitoring station 20. The client tracking unit 13 receives and stores time-coded geolocation (position) information received from the GPS satellites 17. The client tracking unit 13 is thus used to track the position of the client 11 carrying it.

The portable monitoring device 40 is used by the monitoring individual 41 to communicate wirelessly by way of the wireless communication network 18 with the central monitoring station 20 and with the client tracking unit 13. The portable monitoring device 40 may communicate wirelessly using Voice Extensible Markup Language (VXML) or GSM SMS (Short Message Service) messaging.

It is to be understood that the monitoring individual 41 may also communicate with the central monitoring station 20 using the personal computer 42, laptop computer 43 or telephone 44, using wire line connections 48. The system 10 may also employ a field verification unit 80 that is used by the monitoring individual 41 to perform "drive-by" monitoring of clients 11. An exemplary field verification unit 80 is discussed with regard to FIGS. 10–12.

As is shown in FIG. 2, the central monitoring station 20 or computer system 20 comprises a plurality of telephone modems 21 and a plurality of GSM modems 22. The central monitoring station 20 comprises a processor layer including a plurality of data processors 23–27. Exemplary data processors 23–27 include a GPS processor 23, an RF processor 24, and an integrated voice recognition (IVR) processor 26. The GPS processor 23 processes GPS-related data derived from the client tracking unit 13 and monitoring unit 14. The RF processor 24 processes radio frequency (RF) data derived from the transmitter 12 and monitoring unit 14. The integrated voice recognition (IVR) processor 26 processes voice commands transmitted by the portable monitoring device 40 carried by the monitoring individual 41.

The monitoring software 31 at the monitoring center 20 comprises the database 30 that stores information relating to the monitored clients 11. Operators 32 at the monitoring center 20 interface with the monitoring software 31 in order to monitor the clients 11. A web server 33 interfaces with the database 30 to allow the portable monitoring device 40 to remotely and wirelessly track monitored clients 11, and access, review, and change information relating to the monitored clients 11. This is a key aspect of the present invention.

In addition to interfacing with the portable monitoring device 40, the web server 33 allows other devices operated by the monitoring individual 41 to interface with the monitoring software 31. For example, the monitoring individual 41 may choose to use a personal computer (PC) 42, a laptop computer 43, or a conventional telephone 44 to communicate with the web server 33. The personal computer (PC) 42 and laptop computer 43 communicate over a conventional telephone line, while the conventional telephone 44 interfaces by way of a VXML (Voice Extensible Markup Language) interface to the web server 33.

VXML, or VoiceXML, technology allows a user to interact with the Internet using voice-recognition technology. Instead of a traditional browser that uses HTML, a keyboard and a mouse, VXML uses a voice browser and/or telephone. Using VXML, a user interacts with voice browser by listening to audio output that is either pre-recorded or computer-synthesized and submitting audio input through the user's natural speaking voice or through a keypad, of a telephone.

The monitoring individual 41 (such as a law enforcement officer, for example) carries the portable monitoring device 40, which incorporates wireless communication and web browser capabilities. The portable monitoring device 40 accesses the web server 33 at the monitoring center 20 by way of GSM SMS (Short Message Service) communication protocols, or using VXML (voice layer) protocols to interface with the monitoring software 31 and database 30.

This permits the monitoring individual 41 to access the central monitoring station 20 by way of the wireless network 18 (GSM cellular network 18) and obtain status information, or change information, regarding those clients 11 he or she is responsible for. Information regarding specific clients 11 or a group of clients 11 may be retrieved from the database and transmitted to the portable monitoring device 40 using GSM capabilities of the portable monitoring device 40. This will be discussed in more detail below with regard to FIGS. 6–9 and 12.

The monitoring center 20 thus comprises hardware, software and firmware applications required to implement multiple supervision capabilities, such as IVR, RF, and GPS, for example. In addition, the monitoring center 20 maintains full 24-hour operation with operators 32, educated and trained to interact with field personnel, officers 41 working for different agencies, and the interactive components of the system 10 deployed in the field.

The monitoring center 20 is configured to receive and respond to alarms presented by electronic monitoring equipment and monitoring systems. The monitoring center 20 comprises processing platforms required to interface the portable monitoring device 40 to the monitoring software 31 and database 30 and to the client tracking unit 13. The multiple layers of communication and data interfaces allow communication and interaction between the portable monitoring device 40, the monitoring center 20 and the client tracking unit 13.

For example, the IVR processor 26 comprises algorithms used for voice commands and voice recognition. The IVR processor 26 records voice patterns of a monitoring individual 41 to ensure integrity and future confirmation of voice patterns. IVR algorithms and processing are generally well-understood in the art.

The RF processor 24 receives RF signals from all client tracking unit 13 that provide status information indicating whether the client 11 leaves home, returns home, or enters a restricted zone, for example. The information is correlated with schedule and exclusion zone information relating to each client 11. Based upon a notification matrix dictated by predefined agency requirements, the monitoring center operators 32 respond and react to each alert that is received.

Improved capabilities of the monitoring center 20 provided by the present invention allow communication with the portable monitoring device 40 carried by the monitoring individual 41. Data transmissions from transmitters 12 are received by the communication software 31*a*, indicating leave home, return home, enter a restricted zone, transmitter tamper and battery status, for example. The communication software 31*a* pushes (transmits) all information to the portable monitoring device 40 carried by the monitoring individual 41 and to the database 30 for historical reporting.

The GPS location data received from client tracking units 13 is received and stored in the database 30. The data is pulled at intervals determined by the GPS monitoring level of the particular client 11. The stored data is stored in the database 30 for historical reporting and is made available for disbursement to the portable monitoring device 40 as required or as demanded by the monitoring individual 41.

Figure 16:
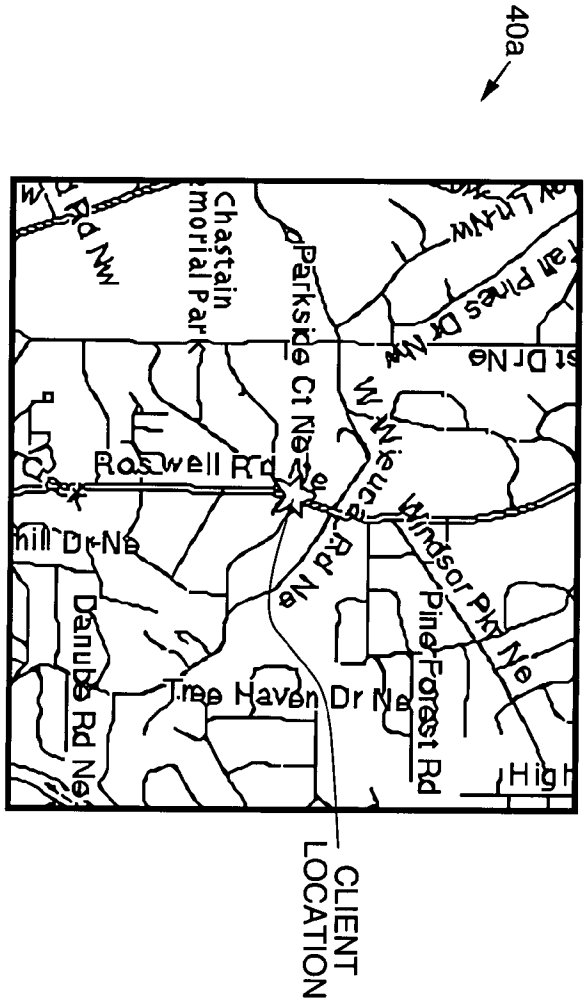
FIG. 16 illustrates an exemplary screen display on the portable monitoring device showing a map and related data showing location of a client.

The GPS longitudinal and latitudinal data is correlated with localized maps to derive actual address information relating to the location of the client 11. Upon request by the monitoring individual 41, a location is presented to the portable monitoring device 40 displaying the client's location on a map and with the detail of the corresponding address information. This is shown in FIG. 16. This mapping layer allows the data to be parsed to the database 30 for historical reporting as well as to provide immediate information to the portable monitoring device 40. The received location information is compared with local information stored on the client tracking unit 13 to determine an immediate geo-zone violation which is reported to the portable monitoring device 40.

The client tracking units 13 and portable monitoring device 40 are each configured to allow verbal communication with the operators 32 at the monitoring center 20. The operators 32 are knowledgeable and able to communicate with officers 41, when necessary, regarding all aspects relating to supervision. The operators 32 are also available to clients 11, as necessary, to assist in schedule changes, communication of duress or emergency information, or to communication of information between the monitoring individual 41 and the client 11 and vice-versa, as required.

Figure 3:
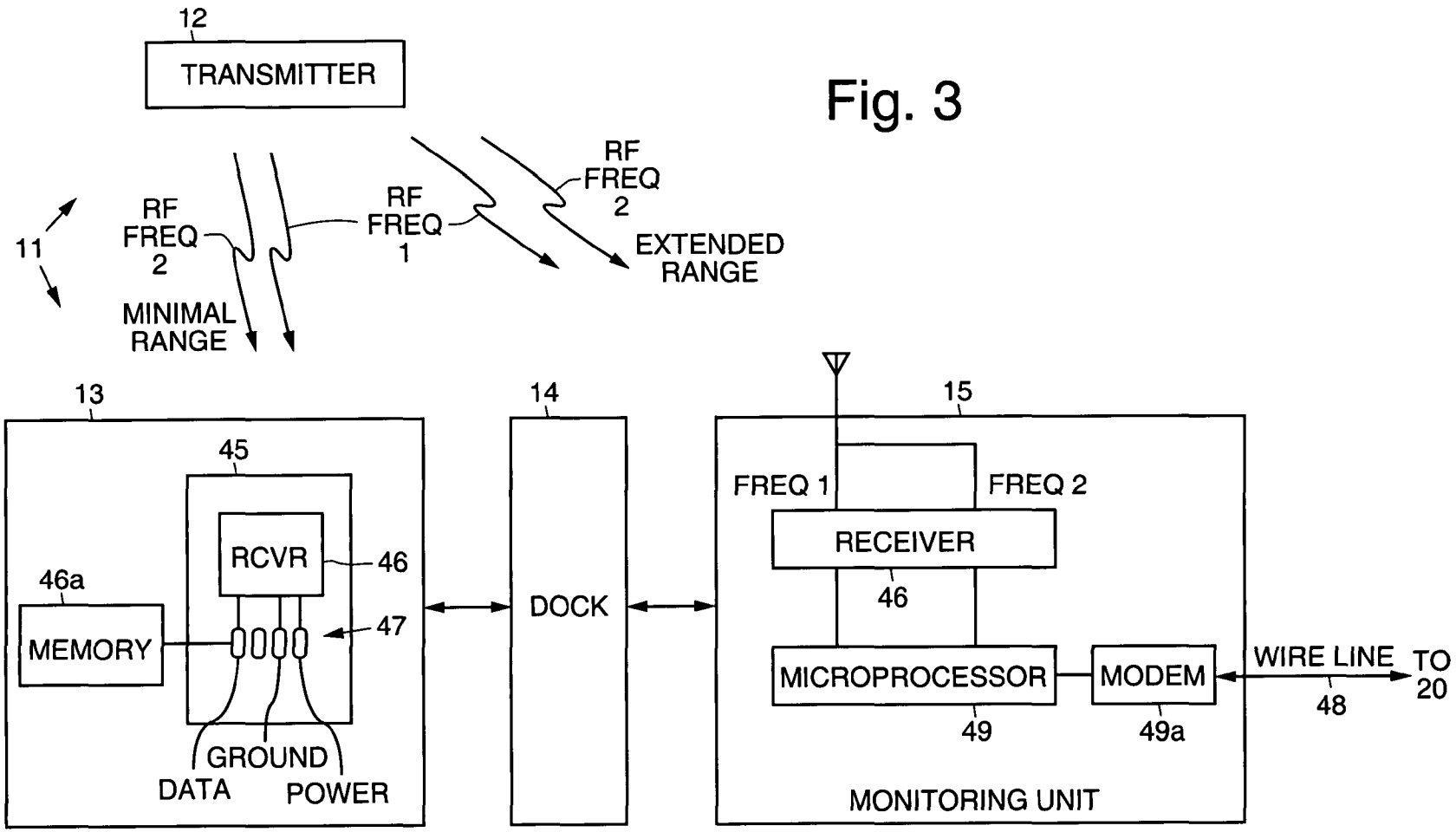
FIG. 3 illustrates details of an exemplary client tracking unit, docking station and monitoring unit employed in the system shown in FIGS. 1 and 2.

FIG. 3 illustrates details of an exemplary client tracking unit 13, docking station or dock 15, and monitoring unit 14 employed in the exemplary system 10. The exemplary client tracking unit 13 comprises a removable battery 45 that includes an RF receiver 46 for receiving RF signals from the transmitter 12. The client tracking unit 13 is powered by the battery 45 and is electrically coupled to the client tracking unit 13 by way of connector pins 47 for the battery 45. Two of the connector pins 47 are power and ground pins 47, while a third pin 47 couples data to the client tracking unit 13 for storage and/or transmission. The client tracking unit 13 also comprises a memory 46*a* that is used to store received data.

RF signals transmitted by the transmitter 12 are received by the receiver 46 in the battery 45 of the client tracking unit 13. The client tracking unit 13 monitors receipt of the signals from the transmitter 12. The client tracking unit 13 thus monitors the substantial collocation of the client tracking unit 13 with the transmitter 12 and if the transmitter 12 is tampered with by the client 11. If the client tracking unit 13 and transmitter 12 become separated, such as if the client 11 does not keep the client tracking unit 13 with him or her, of if the transmitter 12 is disabled or removed from contact with the client 11, an alarm event is detected by the client tracking unit 13. The client tracking unit 13 reports the alarm event to the central monitoring station 20 which is stored in the database 30.

The receiver 46 embedded in the battery 45 of a preferred embodiment of the GPS enabled client tracking unit 13 allows the transmitter 12 to move away from the client tracking unit 13 not less than 15 feet and not more than 20 feet. All alert events discussed previously are monitored within this range and reported immediately if any condition changes.

The client tracking unit 13 may be programmed to transmit alert (GSM) signals to the central monitoring station 20 immediately if the transmitter 12 is tampered with, and based upon customer-defined criteria. In addition, unresolved alert signals may be transmitted to the monitoring individual 41, and resolved alert signals may be transmitted to the central monitoring station 20 for reporting to the monitoring individual 41.

The client tracking unit 13 communicates status (GSM) messages to the central monitoring station 20. The status messages include information regarding current and previous locations of the client tracking unit 13. In addition, the client tracking unit 13 may be inserted into the dock 15 by way of a serial connection, for example, when the client 11 is home, which connects it to the monitoring unit 14. This allows the client tracking unit 13 to recharge its battery 45 and download location data (status information) stored therein by way of the monitoring unit 14 to the central monitoring station 20.

In a docked state, the receiver 46 of the client tracking unit 13 is made inoperative, allowing the transmitter 12 to have a range of about 150 feet as determined by the receiver and antenna of the monitoring unit 14. When undocked, the RF receiver of the client tracking unit 13 has only about a 15 foot range.

The monitoring unit 14 preferably comprises two receivers 26, 26*a* for receiving signals at the first and second frequencies transmitted by the transmitter 12 (discussed with respect to FIG. 4 below). The two receivers 26, 26*a* are coupled to a microprocessor 49 that is coupled to a modem 49*a*. The microprocessor 49 and modem 49*a* cooperate to communicate with the central monitoring station 20.

The monitoring unit 14 transmits signals to the central monitoring station 20 indicating that the client tracking unit 13 has been docked, indicating that the client 11 has returned home. The monitoring unit 14 also monitors the presence of the transmitter 12 when the client 11 is home. The monitoring unit 14 receives and monitors the two frequencies transmitted by the transmitter 12 while the client 11 is home. The monitoring unit 14 transmits a signal to the central monitoring station 20 at regular intervals. If the client 11 leaves home, the monitoring unit 14 transmits a signal to the central monitoring station 20 indicating that this.

The client tracking unit 13 is a wireless communication device. The client tracking unit 13 is preferably a GPS (Global Positioning System) and GSM (Global System for Mobile communications) compatible communication device 13. A preferable client tracking unit 13 may be a Track Pro 1.1 GSM+GPS Professional Telematics Phone, for example, manufactured by Benefon, located in Finland. The client tracking unit 13 is used in the system 10 to track the client 11 and to permit the client 11 to contact or be contacted by the person tasked with monitoring the client 11. This capability provides tremendous benefits compared with conventional electronic monitoring systems.

While a reduced to practice embodiment of the present invention uses the Global Positioning System, it is to be understood that any comparable or suitable location determining device and/or technology may be used by the present invention. For example, GPS, wireless based tower triangulation or relative positioning from a known origin may be employed. With regard to the use of a GSM communication technology, it is to be understood that any comparable or suitable wireless communications medium may be employed in the present invention. While the present invention currently uses cellular telephone devices, it is to be understood that any comparable or suitable wireless communications device may be employed in the present invention. With regard to the use of a portable monitoring device 40 or PDA, the present invention may employ any Internet capable wireless device.

The client tracking unit 13 preferably incorporates a programmable heartbeat. A pre-programmed requirement of each client tracking unit 13 enables the unit 13 to independently report position, status condition throughout the duration of an undocked and/or away-from-the-home-monitoring-unit condition to the central station 20. Depending upon customer requirements, the client tracking unit 13 is programmed to report at predetermined intervals indicating that communication by way of the wireless network 18 is viable, the client tracking unit 13 is in good condition and has not been disabled or otherwise compromised. This status check, or heartbeat, is especially desirable where the client tracking unit 13 is not required to update position information continuously. A failure, multiple failures or any customer-determined failure of the client tracking unit 13 to report a heartbeat expected by the software 33 at the monitoring center 20 is considered an alarm and is immediately reported to the wireless portable monitoring device 40 carried by the monitoring individual 41. Employment of these intelligent features allows the last position of an client 11 to be read, and the time at which acquisition was lost to be known and presented to the monitoring individual 41.

The client tracking unit 13 comprises software that displays schedule and restricted zone reminders to the monitored client 11. Software residing on the client tracking unit 13 may be programmed by way of an upload from the monitoring center 20, or portable monitoring unit 40, to store dates and times of the schedule reminders that are displayed. In addition, the software running on the client tracking unit 13 may be programmed by way of an upload from the monitoring center 20, or portable monitoring unit 40, to store restricted zone reminders, based upon geolocation data gathered by the client tracking unit 13. The software running on the client tracking unit 13 may be programmed to provide one button voice contact with the monitoring center 20 or monitoring individual 41. The software running on the client tracking unit 13 may be programmed to monitor its battery condition and provide an alert to the monitored client 11.

The software running on the client tracking unit 13 in conjunction with the RF transmitter interface may be readily programmed to monitor and report transmitter proximity, monitor and report strap status, monitor and report transmitter battery status, and receive and transmit positional data.

The memory 46*a* of the client tracking unit 13 allows storage of data (way points) regarding the client 11 for on-demand downloaded display on the portable monitoring device 40, storage of restricted zone points, storage of contact names and numbers, and storage of specific, changeable transmitter identification and status data.

The GSM voice capabilities of the client tracking unit 13 allows direct voice contact, on demand, between the client 11 and the monitoring individual 41, and between the client 11 and the monitoring center 20.

The GSM data capabilities of the client tracking unit 13 allows text message display on the display, schedule reminders, zone awareness and contact reminders derived from stored information. The GSM data capabilities of the client tracking unit 13 also allows responses to the monitored client 11 sent from the monitoring individual 41 or monitoring center 20 via SMS messages based upon data received by either the monitoring individual 41 or monitoring center 20.

The assisted GPS capabilities of the client tracking unit 13 allows for a "warm start" of GPS initialization in order to facilitate immediate position acquisition from the client tracking unit 13.

Figure 4:
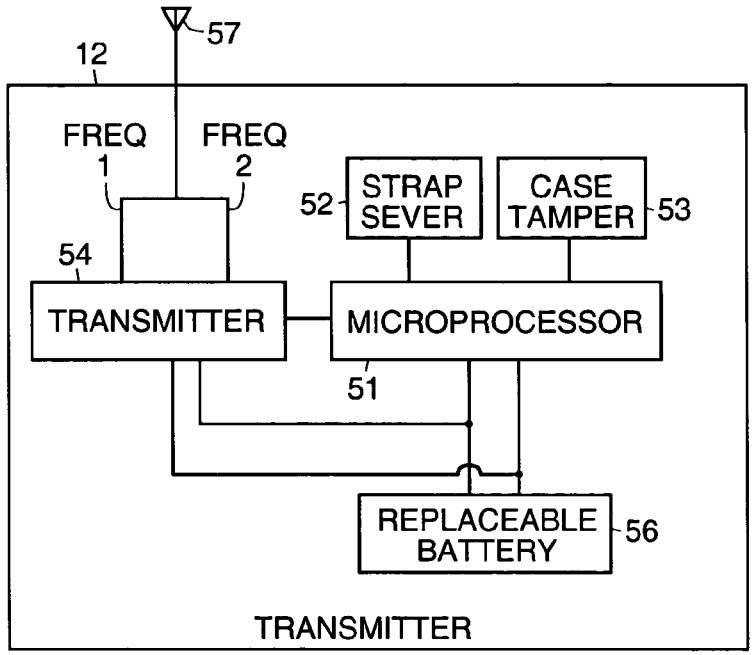
FIG. 4 illustrates details of an exemplary transmitter, or ankle bracelet, employed in the system shown in FIGS. 1 and 2.

FIG. 4 illustrates details of an exemplary transmitter 12, or ankle bracelet, employed in the system 10 shown in FIGS. 1 and 2. In accordance with the present invention, an improved exemplary transmitter 12 comprises a dual frequency transmitter 12 that transmits identifying information at two different frequencies (433.28 MHz and 434.56 MHz, for example) separated in time (7.5 seconds, for example). Two different frequencies are preferably used to minimize the possibility of missed communication events between the transmitter 12 and the client tracking unit 13.

Figure 4A:
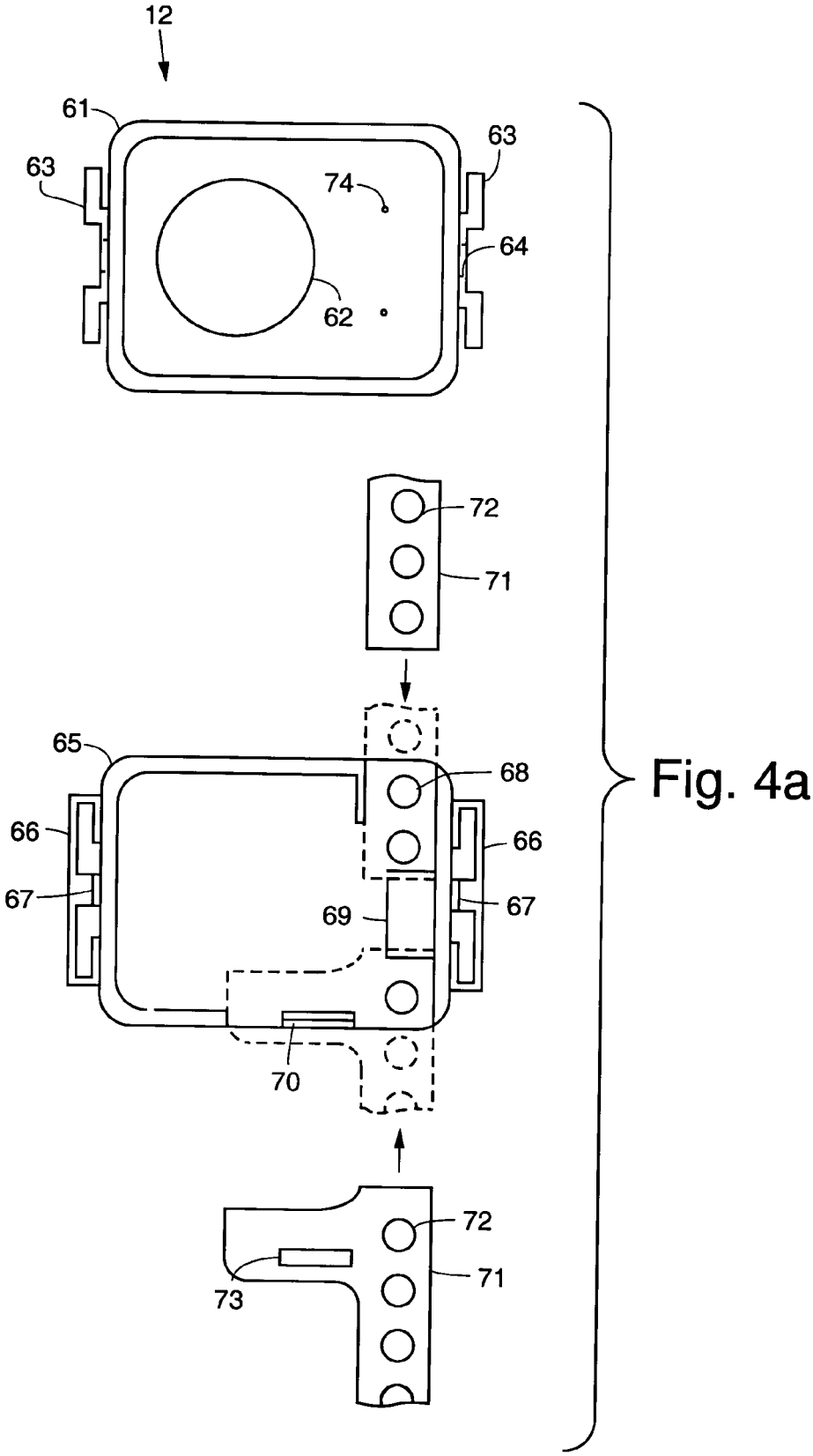
FIG. 4*a* illustrate design details of an exemplary transmitter employed in the system shown in FIGS. 1 and 2.

A preferred embodiment of the transmitter 12 is secured to the client 11 by a strap 71, for example (FIG. 4*a*), so that it is secured around the client's ankle and locked using a disposable base plate 75, for example (FIG. 4*a*). The transmitter 12 comprises a microprocessor 51 that is powered by a replaceable battery 56. A transmitter circuit 54 comprising an antenna 57, which is preferably a dual frequency transmitter circuit 54 is coupled to the microprocessor 51.

The transmitter 12 has switches 52, 53 or other mechanisms that are coupled to the microprocessor 51 that indicate if the strap 71 is severed so that the transmitter 12 is removed from contact with the client 11, or is disabled by the client 11, or if the transmitter case is tampered with. The switches or other mechanisms disable transmission of RF signals from the transmitter 12.

FIG. 4*a* illustrate details of the design an exemplary transmitter 12 employed in the system shown in FIGS. 1 and 2. The transmitter 12 is preferably made of molded plastic components, for example. The transmitter 12 has a two-piece design comprising a disposable base plate 65 that mates with a transmitter case 61. The disposable base plate 65 comes in direct contact with the skin of the client's ankle and can be discarded after each monitoring sentence. The transmitter 12 embodies snap-together concept without the need for rails, screws, clamps or latches. This concept permits easier field installation of electronic monitoring equipment.

The transmitter case 61 has an internal battery cavity 62 in which the battery 56 is disposed. Two stepped U-shaped tabs 63 are formed on the exterior of the transmitter case 61. An opening 64 is formed in a lower portion of each of the stepped tabs 63 that are used to lock the transmitter case 61 to the disposable base plate 135. A plurality of tamper pins extend inwardly from the surface of the transmitter case 61 that penetrate the strap 71 when the transmitter 12 is assembled. The tamper pins allow current to flow through the strap 71, which provide an indication if the strap 71 has been severed.

The disposable base plate 65 has a plurality of slides 66 with internal cavities formed on the exterior thereof that are designed to slide over the stepped tabs 63. The plurality of slides 66 have centrally located locking slides 67 that insert and lock into the mating openings 64 in the tabs 63 to lock the transmitter case 61 to the disposable base plate 65. The disposable base plate 65 has a plurality of strap pegs 68 extending from its surface. A strap retainer tab 69 is formed adjacent to the plurality of strap pegs 68 that is used to retain ends of the strap 71.

The strap 71 has a plurality of holes 72 formed therein that are used to secure the strap 71 to the transmitter 12. One end of the strap 71 is larger than the opposite end and has a rectangular opening 73 formed therein the is captivated by a portion of a vertical sidewall 70 of the base plate 65.

To secure the strap 71 to the transmitter, the larger end of the strap 71 is placed over the base plate 65 such that the rectangular opening 73 is held by the portion of the vertical sidewall 70 and a hole 72 adjacent the end of the strap 71 is held by an adjacent strap peg 68 and is disposed under the strap retainer tab 69. The opposite end of the strap 71 is trimmed to an appropriate length and the end of the strap 71 is inserted over strap pegs 68 on the opposite side of the base plate 65 so that holes 72 are held by the strap pegs 68 and the end of the strap 71 is disposed under the strap retainer tab 69. The transmitter case 131 is then mated with the base plate 65 by sliding the stepped tabs 63 into the internal cavities of the plurality of slides 66 until the openings 64 are secured by the locking slides 67. There is an audible "snap" that confirms that the retainer tabs are locked to the openings 64. This locks the transmitter case 61 to the disposable base plate 65 and secures the strap 71 to the transmitter 12.

Removal of the transmitter 12 from the client's ankle requires cutting the locking slides 67 using a tool, whereafter the transmitter case 61 and the disposable base plate 65 may be separated from each other. The base plate 65 may be disposed of and a new disposable base plate 65 used with the transmitter 12 for a subsequent client 11.

The exemplary transmitter 12 communicates certain data and transmitter status within a maximum 20 foot range to the GPS enabled client tracking unit 13 (up to a 400 foot open air range). The data transmitted during each transmission include a number of monitored events. These events include battery status, strap sever, and transmitter tamper. The life of the battery 66 in the exemplary transmitter 12 enables the transmitter 12 to transmit over a 14-month continuous transmission period. A low battery power status signal is transmitted if the life span approaches a three day reserve supply. If the strap 71 is completely severed, event data is transmitted. Any attempt to remove the transmitter 12 or partially remove the strap 71 results in a transmitted event signal. These are different from a complete strap sever event.

If the transmitter 12 moves beyond the range of the client tracking unit 13, it is reported as an away event. Status events cannot be monitored nor reported until the transmitter 12 returns to an acceptable range of the client tracking unit 13 or the monitoring unit 14. The transmitter 12 sends an encrypted data packet alternating in frequency to eliminate possible interference. Transmission of encrypted data packets include transmitter ID, battery life, strap and unit condition data.

Figure 5:
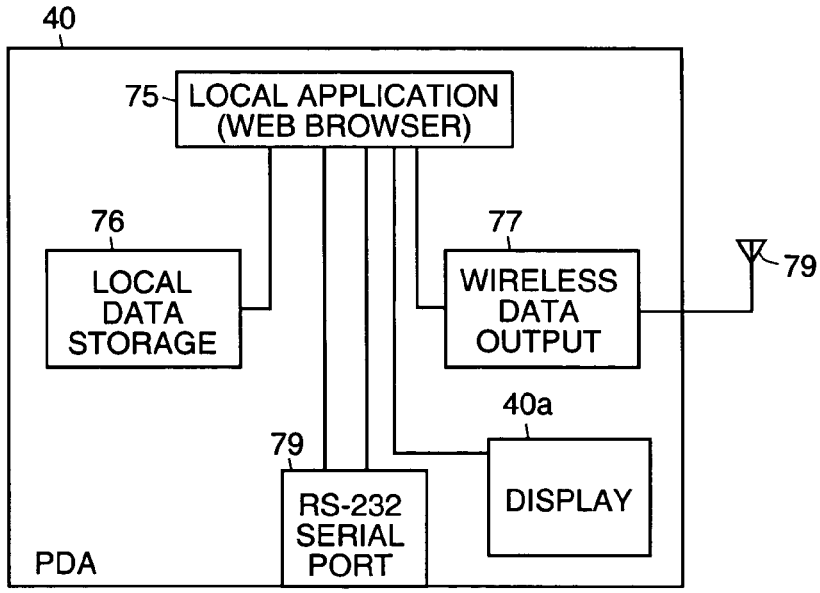
FIG. 5 illustrates an exemplary portable monitoring device employed in the system shown in FIGS. 1 and 2.

FIG. 5 illustrate physical details of an exemplary portable monitoring device 40 employed in the system shown in FIGS. 1 and 2. The portable monitoring device 40 is preferably a personal digital assistant (PDA) or pocket PC, for example. The portable monitoring device 40 includes a local web browser application in accordance with the present invention that runs on a microprocessor 75, a local data storage device 76 coupled to the microprocessor 75, a wireless data output 77 with antenna 79, a serial port 78, such as an RS-232 serial port 78, and a display 40*a*.

The portable monitoring device 40 provides direct, real-time, wireless voice and data access to both the monitored client 11 and the monitoring center 20. The portable monitoring device 40 may be programmed to directly alert the monitoring individual 41 via wireless communication upon the occurrence of an alert event generated by the client tracking unit 13 (GPS) or monitoring unit 14. The portable monitoring device 40 allows placement and receipt of calls directly to and from the monitoring center 20 and the monitored client 11. The portable monitoring device 40 sends and receives data transmissions via wireless connection. As will be described in more detail below, the portable monitoring device 40 may be used to change the schedule of a client 11, view activity of a client 11, view the violation history of a client 11, locate a client 11, call a client 11, and view the status of a client 11.

It is to be understood that the portable monitoring device 40 is not limited to any specific device or specific manufacturer or wireless service provider. The portable monitoring device 40 may be configured on any wireless device that has the ability to place voice calls, send and receive data packets and initialize and maintain a web browsing session. The form factor is inherently easier on the end user when a screen display is larger than traditional cellular phone screens and has the ability to access a keypad or keyboard, either electronically or button controlled, but the end user may determine the optimum device for the needs of the client 11, agency, or other end user. Use of the exemplary portable monitoring device 40 will be discussed with reference to FIGS. 6–12.

Figure 6:
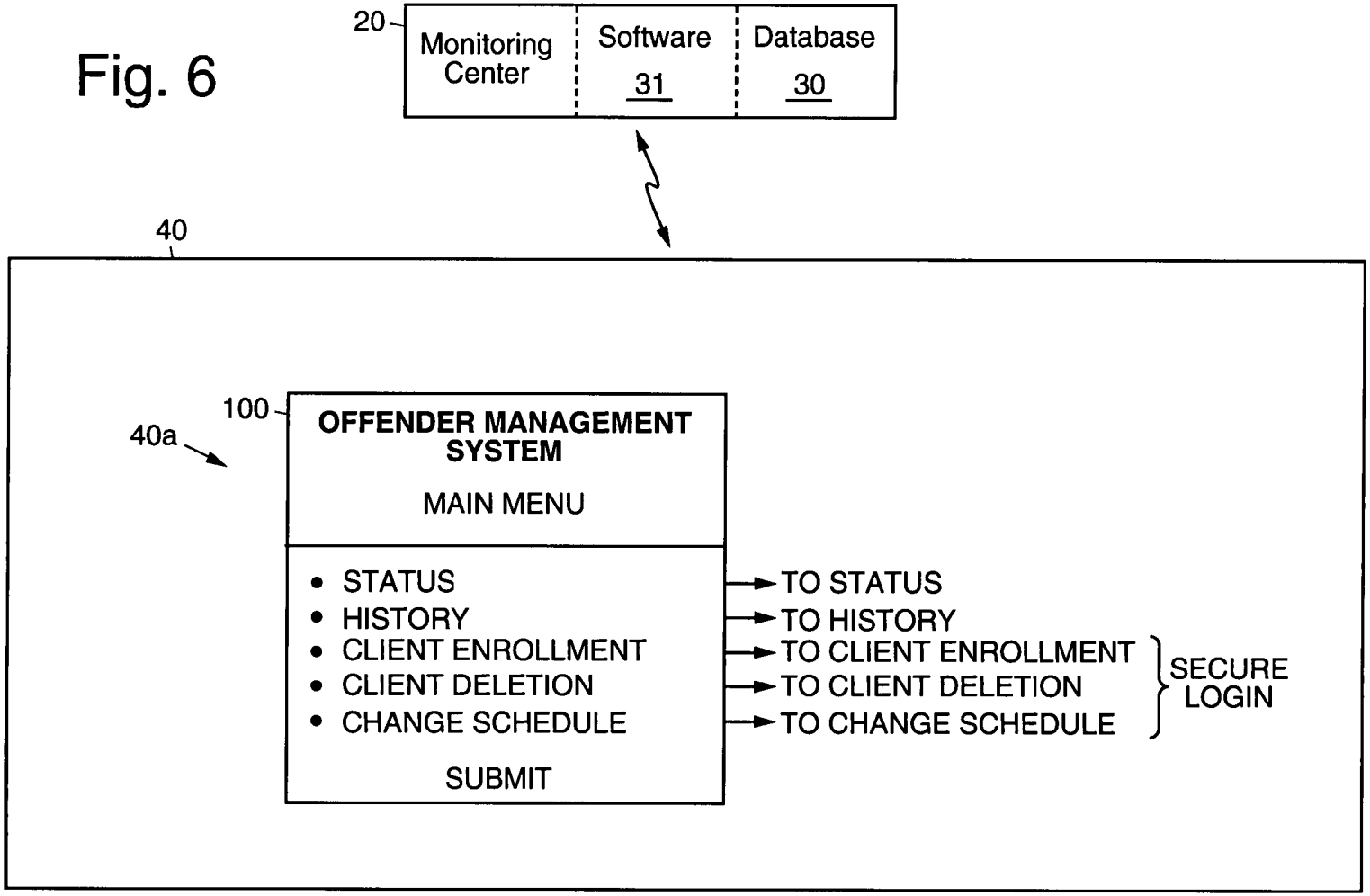
FIG. 6 illustrates basic communication between the portable monitoring device and the monitoring center of the exemplary electronic monitoring system shown in FIGS. 1 and 2.

FIG. 6 illustrates basic communication between the portable monitoring device 40 and the monitoring center 20 of the exemplary electronic monitoring system 10 shown in FIGS. 1 and 2. A key aspect of the present invention is that it connects the portable monitoring device 40 to the central monitoring station 20 to allow remote access and control of data regarding monitored clients 11 by the monitoring individual 41. FIGS. 7–12 illustrate operations that are performed using the portable monitoring device;

The portable monitoring device 40 preferably comprises a personal digital assistant (PDA) or pocket PC, for example. The portable monitoring device 40 has a display screen 40*a*, and a keypad or other input device (not shown) that allows input, selection and changing of information presented on the display screen 40*a*.

Data derived from the database 30 that is accessed by the monitoring individual 41 is presented on the display screen 40*a* of the portable monitoring device 40. When the portable monitoring device 40 is powered up, a login screen 99 is displayed. The monitoring individual 41 enters a login name and password and, once entry is granted, has a main menu 100 displayed.

The main menu 100 displays five selectable tasks that may be performed by the monitoring individual 41. The selectable tasks are associated with a plurality of selectable buttons or icons. These tasks relate to status 101, history 120, new client enrollment 130, client deletion 140, and schedule change 150, illustrated in FIGS. 7–12.

Selecting the status task from the main menu 100 allows the monitoring individual 41 to view the status of a specific client or group of clients. Selecting the status task presents an offender status screen 102 with selectable "By Individual" and "by Group" buttons or icons. Selecting the "By Individual" icon results in an individual information screen 103 where the monitoring individual 41 selects the first letter of the last name of a client 11. Once a letter is selected, a display screen 104 is presented that shows the names of all clients 11 that start with that letter are displayed, through which the monitoring individual 41 can scroll to identify a specific client 11. Selecting a particular client 11 from the list results in presentation of an officer display screen 113 (FIG. 11) to the monitoring individual 41.

Selecting the "By Individual" icon results in a group status screen 105 that shows the total population of clients 11 that the monitoring individual 41 is responsible for. Three selectable tasks are displayed, relating to "additions" to the population, "deletions" from the population and "current status" of clients 11 in the population are displayed. Selecting the "additions" icon presents a display screen 106 that shows the names of all clients 11 added to the population on the current day. Selecting the "deletions" icon presents a display screen 107 that shows the names of all clients 11 deleted from the population on the current day.

Selecting the "current status" icon presents a "current Status" screen 108 that shows the total population of clients 11 that the monitoring individual 41 is responsible for. Four selectable icons are displayed corresponding to those clients 11 that are "Home", "Away", "Late", and have outstanding "Alerts.

Selecting the "Home" icon presents a display screen 111 that shows a list of names of all clients 11 that are presently at home, along with their identification numbers and type of monitoring that is being performed. Selection of a particular client 11 from the list results in presentation of the officer control screen 113 (FIG. 11) to the monitoring individual 41.

Selecting the "Away" icon presents a display screen 112 that shows a list of names of all clients 11 that are presently away from home, along with their identification numbers and type of monitoring that is being performed. Selection of a particular client 11 from the list results in presentation of the officer control screen 113 (FIG. 11) to the monitoring individual 41.

Selecting the "Late" icon presents a display screen 114 that shows a list of names of all clients 11 that are presently away from home and are late from returning home, along with their identification numbers and type of monitoring that is being performed. Selection of a particular client 11 from the list results in presentation of the officer control screen 113 (FIG. 11) to the monitoring individual 41.

Selecting the "Alerts" icon presents a display screen 114 (FIG. 12) that shows a list of names of all clients 11 that are presently away from home and are late from returning home, along with their identification numbers and type of monitoring that is being performed. Selection of a particular client 11 from the list results in presentation of the officer alert screen 114 (FIG. 12) to the monitoring individual 41.

Figure 8:
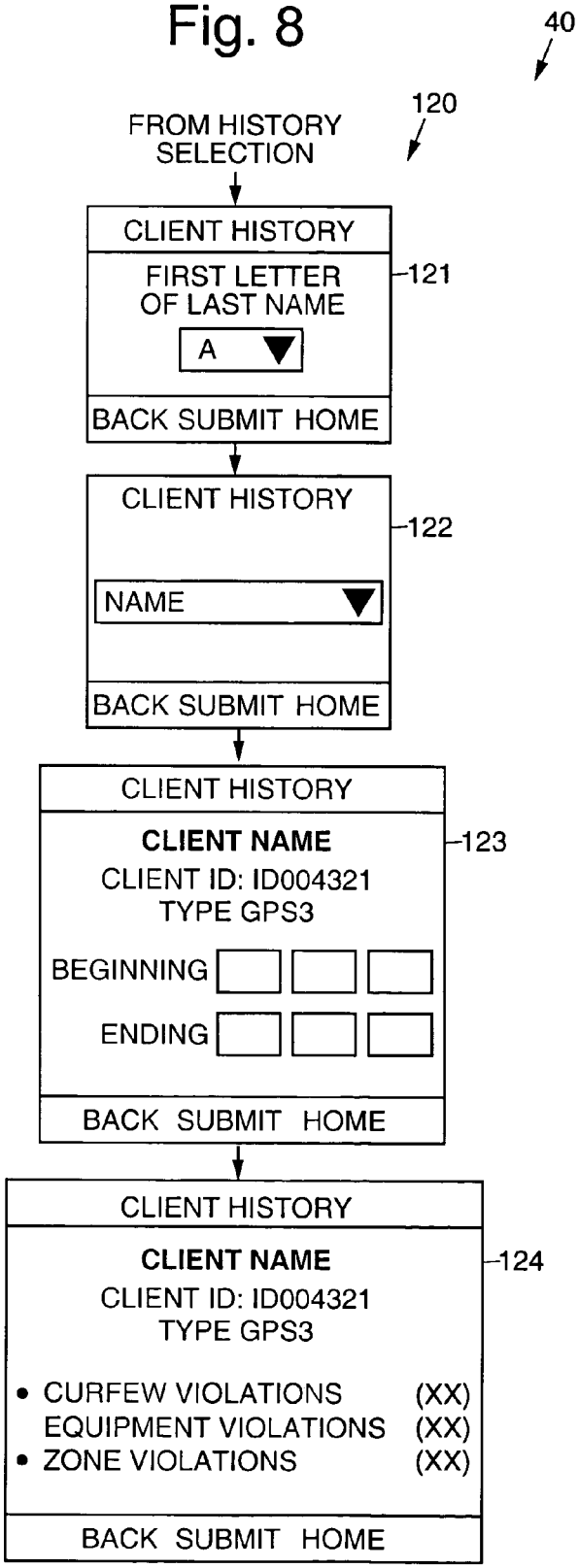

Selecting the "history task" icon from the main menu 100 allows the monitoring individual 41 to view the history 120 of a client. This is shown in FIG. 8. Selecting the "history task" icon results in a client history screen 121 where the monitoring individual 41 selects the first letter of the last name of a client 11. Once a letter is selected, a display screen 122 is presented that shows the names of all clients 11 that start with that letter are displayed, through which the monitoring individual 41 can scroll to identify a specific client 11. Selecting a particular client 11 from the list results in presentation of a display screen 123 containing the client name, client identification number and type of monitoring that is being performed. Beginning and ending dates for the client history are entered into data boxes. Once the respective dates are entered, and submitted, the history of the client 11 is displayed on a display screen 124 including the number of curfew violations, equipment violations and zone violations, for example, that the client 11 has experienced.

Figure 10:
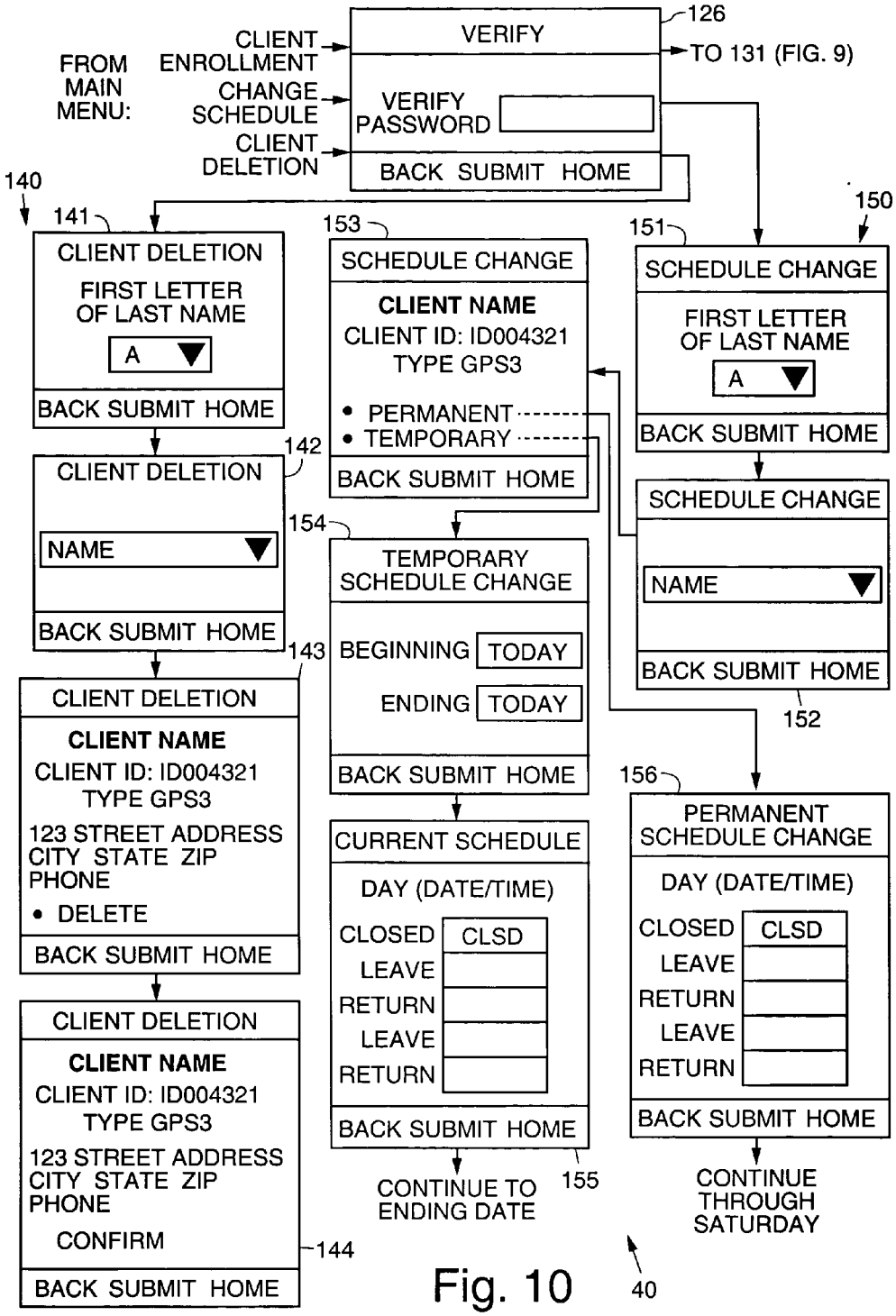

Selecting the "Client Enrollment" icon from the main menu 100 allows the monitoring individual 41 to enroll new clients 11. This may require the monitoring individual 41 to verify his or her password if a time-out has occurred. An exemplary verification screen 126 is illustrated in FIG. 10. The monitoring individual 41 enters his or her password and, once entry is granted, can perform client enrollment, client deletion and schedule change procedures.

Figure 9:
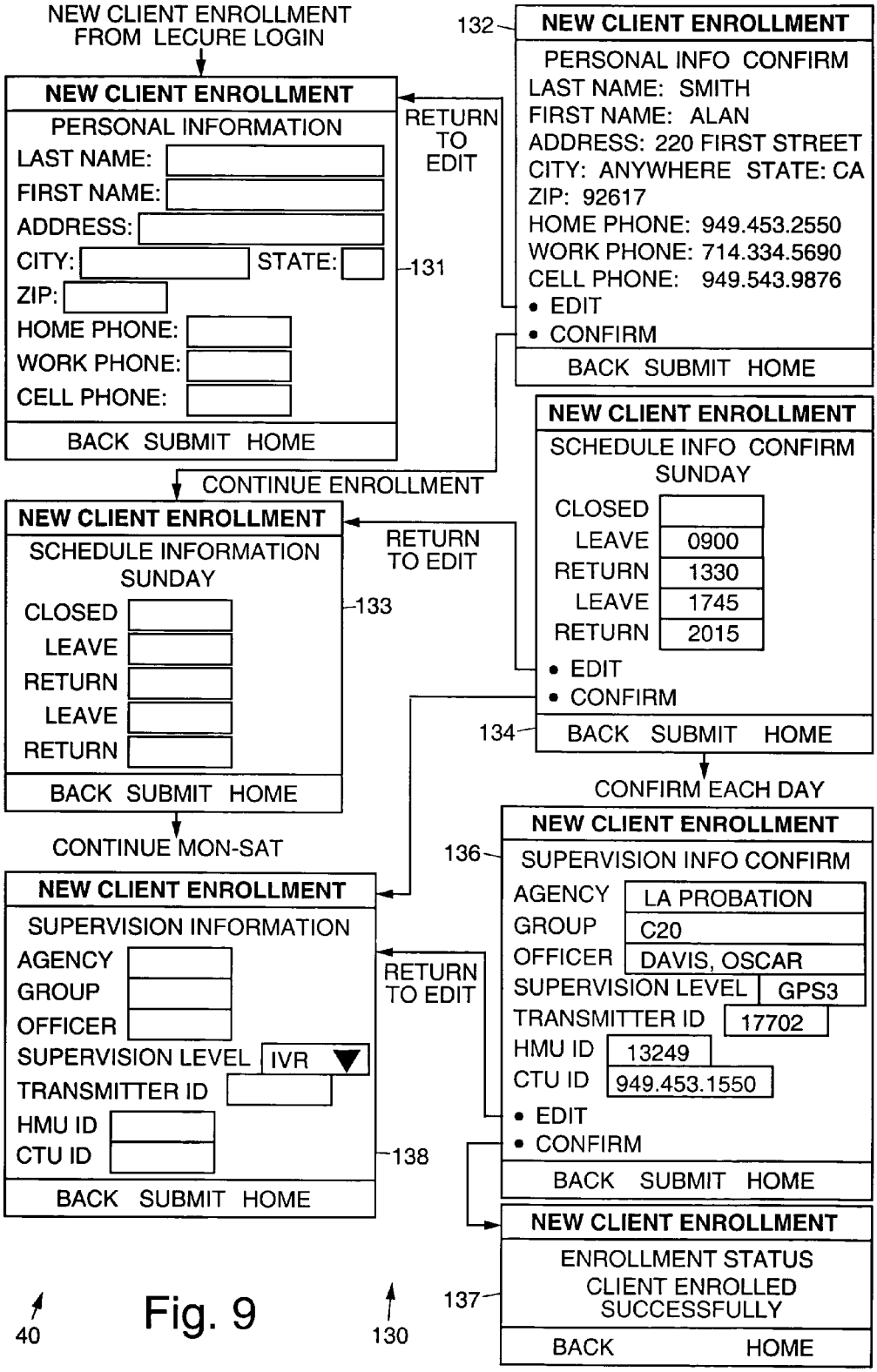

FIG. 9 illustrates exemplary client enrollment 130. Selecting the "Client Enrollment" icon from the main menu 100 presents a new client enrollment display screen 131 to the monitoring individual 41. The monitoring individual 41 enters personal information regarding the new client 11 including last name, first name, address, city, state, zip code, home telephone number, work telephone number and cell telephone number, for example. Exemplary entered data is shown on the filled out screen 132 at the upper right portion of FIG. 9. If editing is required, the "Back" icon is selected which returns to the client enrollment display screen 81 for correction.

Once correct information is completed, the "Submit" icon is selected, which displays a schedule information display screen 83. The schedule information display screen 133 allows entry of scheduling information for the client 11, including times that the client 11 may leave and return home. A "closed" entry may be input which means that the client 11 cannot leave home on that particular day. The schedule information is entered for Sunday and thereafter for Monday through Saturday. Exemplary entered data is shown on the filled out schedule information display screen 134 at the middle right portion of FIG. 9. If editing is required, an "Edit" icon is selected which returns to the schedule information display screen 133 for correction.

Once correct information is completed, a "Confirm" icon is selected, which displays a supervision information display screen 135. The supervision information display screen 135 allows entry of supervisory information relating the client 11 this information includes responsible agency, group within the agency, officer (monitoring individual 41) responsible for the client 11, supervision level which is selectable via a scrollable pull-down menu, transmitted ID, ID number of the monitoring unit 14 given to the client 11, and ID number of the client tracking unit 12.

Exemplary entered data is shown on the filled out supervision information display screen 136 at the lower middle right portion of FIG. 9. If editing is required, an "Edit" icon is selected which returns to the schedule information display screen 135 for correction. Once correct information is completed, a "Confirm" icon is selected, which presents a display screen 137 indicating the client enrollment was successful.

Selecting the "Client Deletion" icon from the main menu 50 (after secure login) allows the monitoring individual 41 to delete clients 11. Client deletion 140 is illustrated in FIG. 10. Selecting the "Client Deletion" icon from the main menu 100 presents a client deletion screen 141 where the monitoring individual 41 selects the first letter of the last name of a client 11. Once a letter is selected, a display screen 142 is presented that shows the names of all clients 11 that start with that letter are displayed, through which the monitoring individual 41 can scroll to identify a specific client 11 who is to be deleted from the population. Selecting a particular client 11 from the list results in presentation of a display screen 143 to the monitoring individual 41 showing the name of the client 11, client ID number and type of monitoring service (supervision). The client's address and telephone number are displayed. Selecting of a "Delete" icon presents a confirmation screen 144 to the monitoring individual. Selecting of a "Confirm" icon deletes the client 11 from the monitored population.

Selecting the "Change Schedule" icon from the main menu 100 (after secure login) allows the monitoring individual 41 to change the schedule of clients 11. Client scheduling 150 is also illustrated in FIG. 10. Selecting the "Change Schedule" icon from the main menu 100 presents a schedule change screen 151 where the monitoring individual 41 selects the first letter of the last name of a client 11. Once a letter is selected, a display screen 152 is presented that shows the names of all clients 11 that start with that letter are displayed, through which the monitoring individual 41 can scroll to identify a specific client 11 who's schedule is to be changed. Selecting a particular client 11 from the list results in presentation of a display screen 153 to the monitoring individual 41 showing the client name, client ID number and type of monitoring service (supervision), along with "Temporary" and "Permanent" selection icons.

Selecting the "Temporary" selection icon presents a temporary schedule change display screen 154 which allows the monitoring individual 41 to enter the effective dates of the temporary schedule change. Once this is done, the "Submit" icon is selected which presents a display screen 155 shown the current schedule of the client 11. The current schedule display screen 155 allows entry of new scheduling information for the client 11, including times that the client 11 may leave and return home. A "closed" entry may be input which means that the client 11 cannot leave home on that particular day. Schedule changes for all days up to the end date are entered.

Selecting the "Permanent" selection icon presents a permanent schedule change display screen 156 which allows the monitoring individual 41 to enter new scheduling information for the client 11, including times that the client 11 may leave and return home. A "closed" entry may be input which means that the client 11 cannot leave home on that particular day. Schedule changes for all days of the week are entered.

Figure 11:
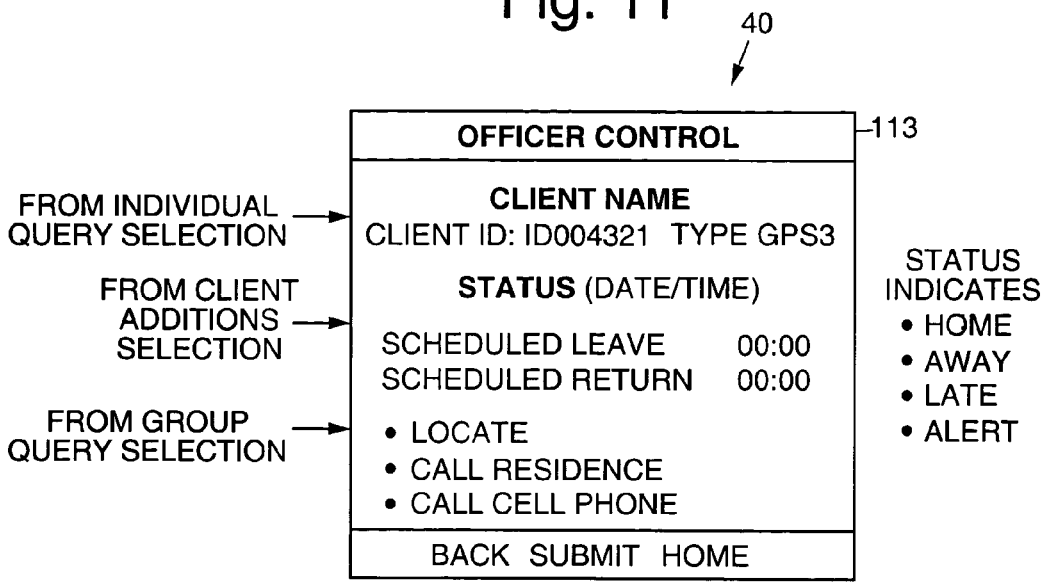

An exemplary officer control screen 113 is illustrate in FIG. 11. The exemplary officer control screen 113 is arrived at when processing individual query selections, client additions selections, and group query selections, illustrated in FIG. 7. The exemplary officer control screen 113 displays the name of the client 11, the client's unit ID number and type of monitoring service (supervision). The officer control screen 113 also displays the current status of the client 11, along with his or her scheduled leave time and scheduled return time. The status that is displayed indicates whether the client 11 is home, is away, is late from returning home, or has an outstanding alert.

From the officer control screen 113, the monitoring individual 41 can select one of three buttons or icons that allows him or her to locate the client 11, call the client's residence, or call the client tracking unit 13 (cell phone) of the client 11. These selectable buttons or icons thus correspond to various tasks associated with monitoring the client 11.

Referring to FIG. 16, if the client 11 is to be located 52, selecting the locate icon causes a map to be displayed that shows the current location of the client 11. The GPS longitudinal and latitudinal data derived from the client tracking unit 13 is correlated with localized maps to determine the current address information relating to the location of the client 11. The location is presented on the display 40*a* of the portable monitoring device 40 showing the client's current location on the map along with details regarding the corresponding address information. Also displayed is the date and time, along with the direction and speed of the client 11. The software 31 at the monitoring center 20 processes the current GPS data derived from the client tracking unit 13 indicating its current location and presents the localized map showing the location and surrounding area where the client 11 is located. The map may be generated by linking to the MapQuest mapping service to access the appropriate map.

Selecting the "Call Cell Phone" button or icon places a wireless telephone call to the client tracking unit 13 (cell phone) of the client 11. Selecting the call residence button or icon places a wireless telephone call to the home telephone of the client 11. The telephone numbers that are called are those entered regarding the client 11 during client enrollment 130 shown in FIG. 9.

The monitoring individual 41 thus has the ability to track the whereabouts of the client 11, and thus track and monitor the client 11 in real time. The monitoring individual 41 also has the ability contact the client 11 due to an unresolved violation, where the client 11 has left or returned home at an inappropriate time, if the client 11 has not returned home, by the scheduled time, or if there is an unresolved alert.

Figure 12:
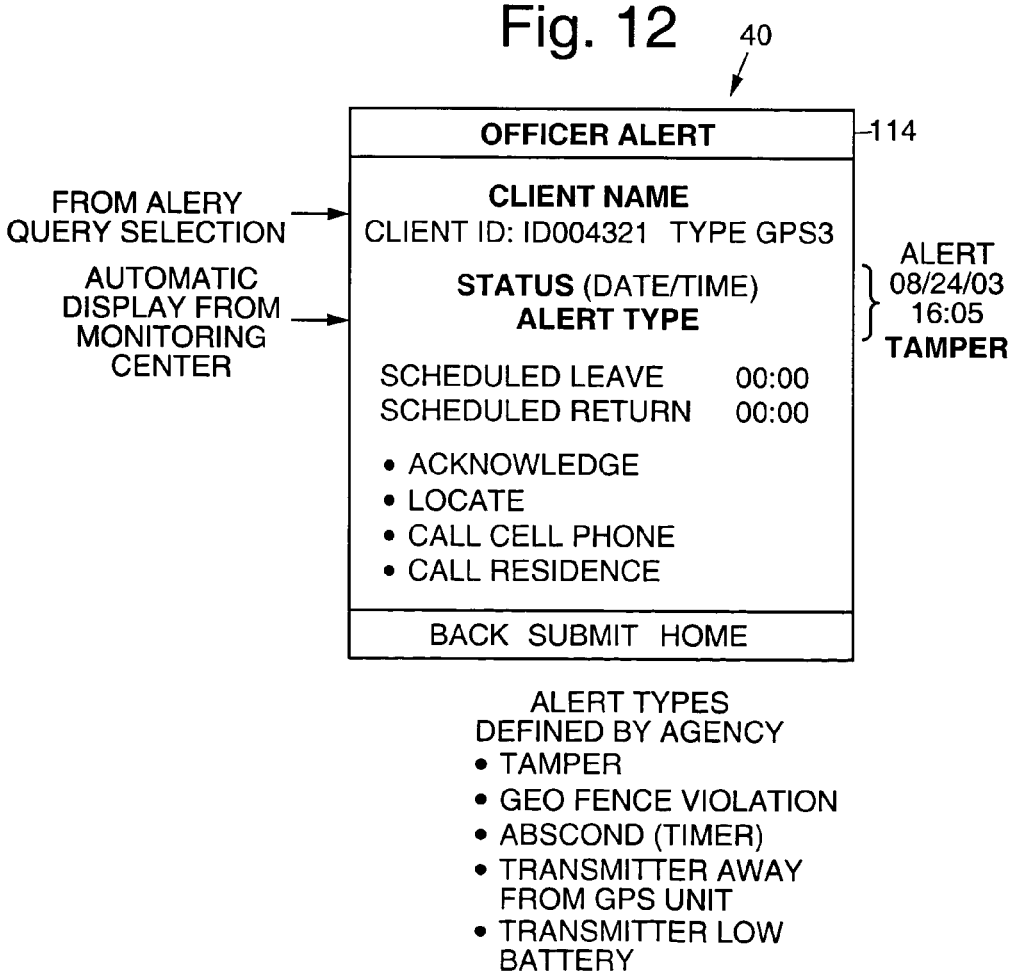

An exemplary officer alert screen 114 is illustrate in FIG. 12. The exemplary officer alert screen 64 is arrived at when processing alert status selections, shown in FIG. 7, or if an alert is forwarded from the monitoring center 20. The exemplary officer alert screen 114 displays the name of the client 11, the ID number of the client tracking unit 13 and type of monitoring service (supervision). The officer alert screen 114 also displays the current status of the client 11, and the alert types. An exemplary alert is shown at the right side of FIG. 12. The officer alert screen 114 also displays the client's scheduled leave time and scheduled return time. The alert types that are displayed indicate whether there is a tamper violation relating to the transmitter 12, whether there is a geo fence violation, if the client 11 has absconded, if the transmitter 12 has been separated from the client tracking unit 13, or if the battery in the transmitter 12 has a low power condition.

A key aspect of the present invention is that changes that are implemented by the monitoring individual 41 may be "pushed" back to the monitoring unit 14 and stored therein. For example, the monitoring unit 14 stores leave and return times for the monitored client 11. The client 11 may have the opportunity to work overtime and must get approval to do so. Otherwise, if the client 11 does not return home by the required time, an alert will be generated because the client 11 did not arrive home in time.

Using the present invention, the client 11 can call the monitoring individual 41 using the client tracking unit 13. If given approval to work overtime, the monitoring individual 41 brings up the temporary change schedule screen, and changes the home arrival time to a new one for each day that the schedule is to be changed. This revised data is stored in the database 30 and "pushed" out to the monitoring unit 14 and stored.

Compare this to conventional systems where the client 11 would need to call the monitoring center 20 and speak with an operator 32 who would then attempt to contact the monitoring individual 41 and arrange for the approval. This is a cumbersome procedure. Contacting the monitoring individual 41 was not always easy, and many times this prevented the client 11 from improving their circumstances.

Also, the fact that the monitoring individual 41 has immediate access to real-time data regarding the client 11 that are monitored, allows for an immediate response to alerts so that timely decisions can be made and measures taken.

In addition, the monitoring individual 41 may use the portable monitoring device 40 to remotely enroll a client 11 that requires monitoring. The enrollment interface of the portable monitoring device 40 allows connection via a secure interface with the monitoring software 31 and the web server 33 at the monitoring center 20. This connection allows enrollment of a new client 11 into any number of electronic monitoring programs, including but not limited to: RF (radio frequency) monitoring, IVR (interactive voice recognition), GPS (global positioning system 1–3), or probation services offered by the assignee of the present invention, for example. A universal enrollment form allows immediate interface with enrollment software 33 at the central station 20, securing necessary information regarding a client 11 as required by each enrollment type (IVR, RF, GPS, or probation services). A selection on the enrollment interface directs the monitoring individual 41 to required fields driven by requisite enrollment type. The portable monitoring device 40 communicates via the browser interface preferentially using a predetermined user login to ensure system security prior to launch of an enrollment session. Failure to identify required fields results in return of an enrollment failure to the user, indicating which fields contain invalid entries, or fields that attempt to report a null response.

The portable monitoring device 40 is designed to allow command and control of all clients 11 involved in supervision. The portable monitoring device 40 is designed to allow interaction on multiple levels, not only GPS monitored clients 11. All clients 11 assigned to a monitoring individual 41 are searchable and given the level of supervision, unique contact or access is gained from a single portable monitoring device 40. The following service levels are supported by the portable monitoring device 40: integrated voice recognition, radio frequency, GPS 1, GPS 2, GPS 2, and probation services.

As for GPS 1 services, data is collected and stored on the client tracking unit 13 until the client 11 returns to the residence. However, a clients schedule, zone awareness (indicating locations where the client 11 cannot go), and unit heartbeat are active.

As for GPS 2 services, data is collected and reported at predetermined intervals throughout the day. The client's schedule, zone awareness, and unit heartbeat are active and the monitoring individual 41 may locate or call the client 11 at any point throughout the day.

As for GPS 3 services, data is collected and continuously reporting position information throughout the day. The client's schedule, zone awareness, and unit heartbeat are active and the monitoring individual 41 may locate or call the client 11 at any time.

Clients 11 that are enrolled in a probation services program and monitored using case management software may be reviewed for any type of delinquency, payment, court requirement, or reporting frequency. Case information and probation requirements may be reviewed, updated or changed using the portable monitoring device 40.

Figure 13:
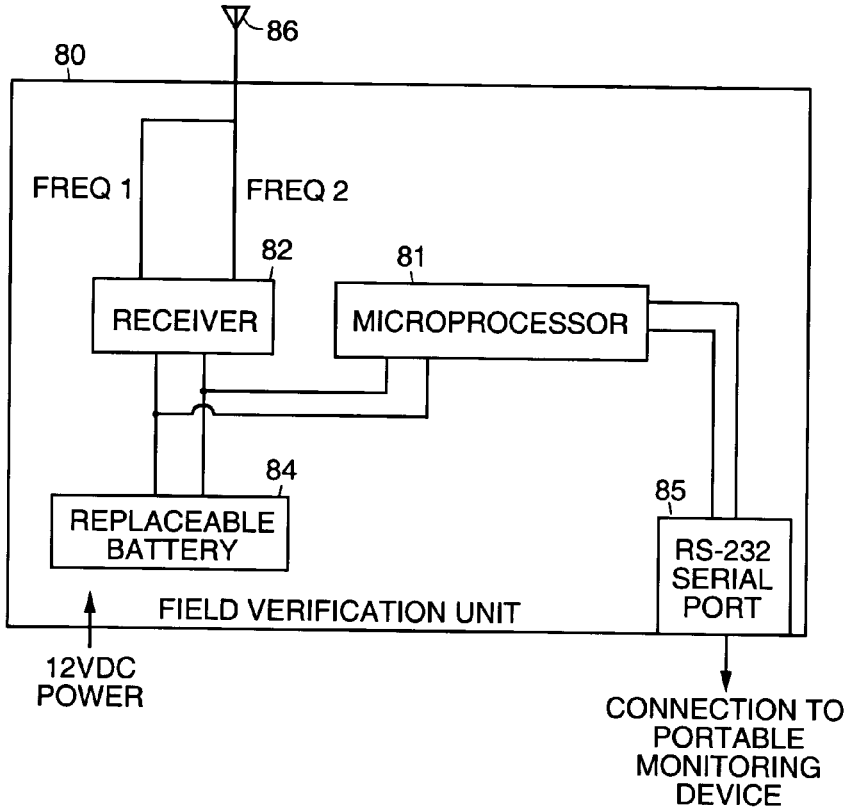
FIG. 13 illustrates an exemplary field verification unit employed in the system shown in FIG. 2.

FIG. 13 illustrates an exemplary field verification unit 80 employed in the system 10 shown in FIG. 2. The field verification unit 80 is used by the monitoring individual 41 to perform "drive-by" monitoring of clients 11. The exemplary field verification unit 80 preferably comprises a dual frequency receiver, a microprocessor controller, an RS-232 serial output, a replaceable battery, an external antenna, an external 12 Vdc power supply, and has PDA power and recharge capabilities.

Figure 14:
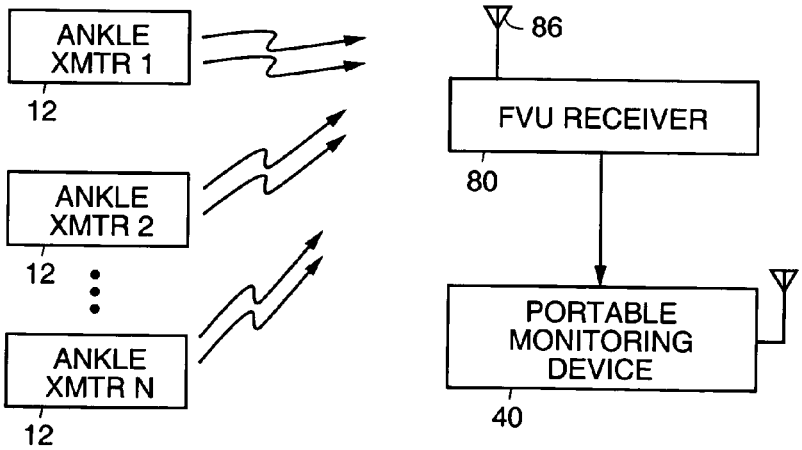
FIG. 14 illustrates use of the exemplary field verification unit.

FIG. 14 illustrates use of the exemplary field verification unit 80. The exemplary field verification unit 80 comprises a microprocessor 81, that is coupled to a serial port 85, such as an RS-232 serial port. The microprocessor 81 is powered from a 12 Vdc power source, such as a vehicle battery, or from a replaceable battery 84. The field verification unit 80 includes a receiver 82 that is powered by the 12 Vdc power source of replaceable battery 84, and which are coupled to a relatively powerful long range antenna 86. The receiver 82 is operable to receive signals at one or more frequencies from nearby transmitters 12. The long range antennae 86 of the field verification unit 80) allows transmitters 12 to be located at distances in excess of 500 feet, thus allowing monitoring individuals 41 to determine offender location by driving by certain locations.

When the field verification unit 80 is powered either externally or internally it remains in a quiescent state until data signal "DTR" is applied from an external computer, such as the portable monitoring device 40. Once powered, the field verification unit 80 receives all data packets transmitting on two different frequencies from any transmitter 12 within a 600 foot open air range that sends the appropriate data protocol. The data is verified using a checksum to ensure integrity. The packets are then transferred by way of the serial port for parsing by the portable monitoring device 40. The functionality of this relation between an external receiver and antenna allows multiple transmitters 12 to be monitored at the same time. The field verification unit 80 allows remote reception of all transmitters 12 and displays the following information: a unique ID of the transmitter 12, health of the transmitter battery, condition of the strap, condition of the transmitter case, signal strength of the transmitter 12, and signal frequency or channel of the transmitter 12.

Figure 15:
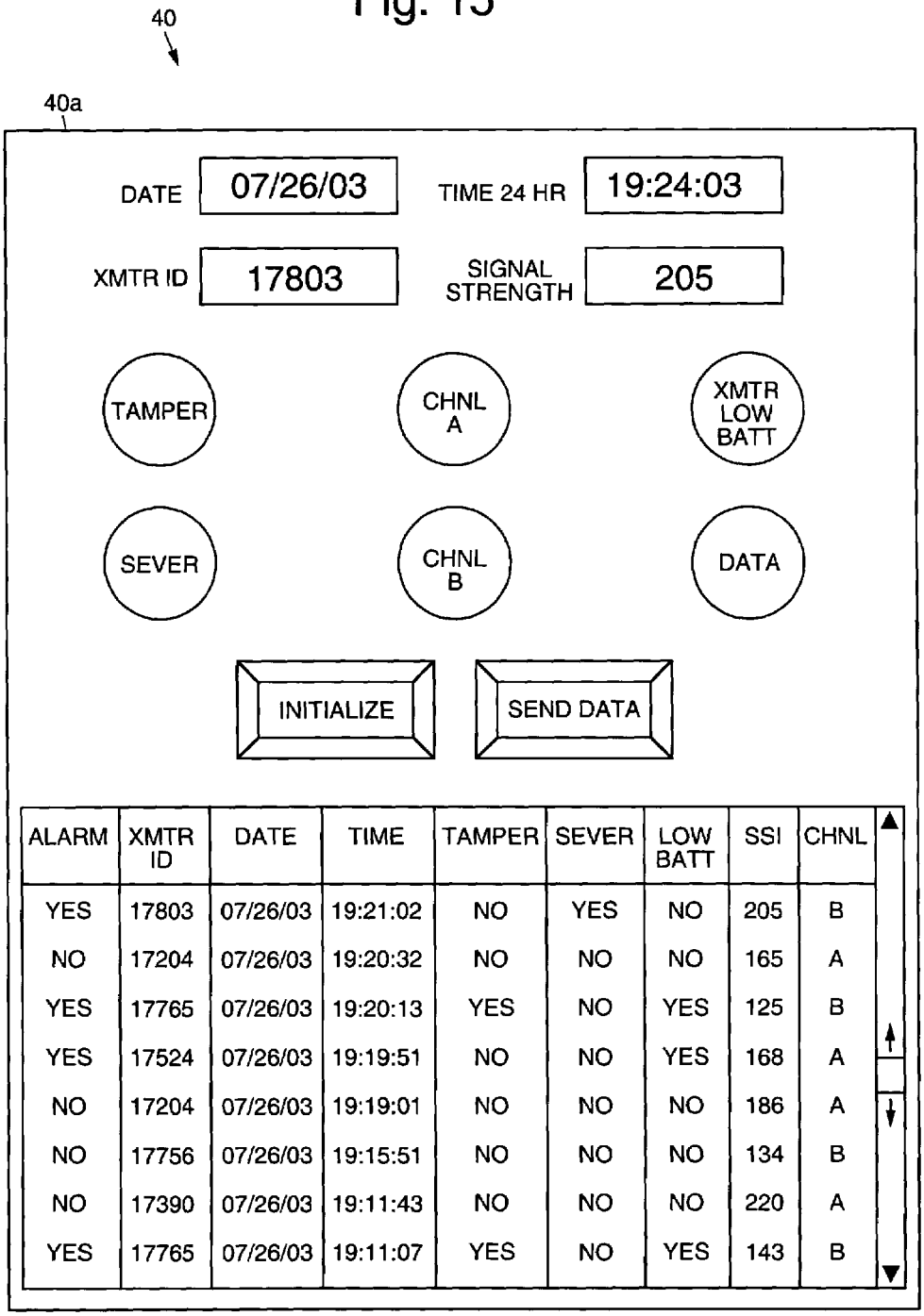
FIG. 15 illustrates an exemplary screen display on the portable monitoring device when using the field verification unit.

The received information is parsed by the portable monitoring device 40 and displayed on its display screen 40*a*. FIG. 15 illustrates an exemplary screen display on the portable monitoring device 40 when using the field verification unit 80.

The portable monitoring device 40 is programmed to log all data received into a nonvolatile SD memory card. The data is exportable wirelessly in data packets to the web server 33 at the monitoring center 20 for inclusion in a client's report, noting that a monitoring individual 41 was in the vicinity of the transmitter 12 and the transmitter ID was logged with status information providing the date and time of capture. The data resident on the SD memory card is also exportable to any tabular style spreadsheet, such as Corel, Excel or in an rtf format separated by tabs for use by the monitoring individual 41 or supervising authority in supervision reports required by his/her department. The portable monitoring device 40 allows input or synchronization with a client's data, thereby translating transmitter ID information to the name of the a client 11 who wears the transmitter 12. The portable monitoring device 40 is connected to the field verification unit 80 via the serial RS-232 port 85. A drive-by application is started on the portable monitoring device 40 that enables the DTR signal to power up the field verification unit 80. The data packets are received by the portable monitoring device 40 through the serial port 85 and are processed by the application. The data is displayed on the local screen of the portable monitoring device 40 and is stored is a local data storage 102 and sent via wireless communication to the web server 33 at the monitoring center 20.

With the above in mind, novel features of the present invention will now be summarized. One aspect provides for a transmitter 12 worn by a client 11 that directly communicates with a client tracking unit 13 (cellular communication device) carried by the client 11. The transmitter 12 preferably transmits dual frequencies to communicate with the client tracking unit 13 carried by the client 11.

Another aspect provides for a wireless portable monitoring device 40 that incorporates cellular telephone and web browser capabilities to provide voice communication between the monitoring individual 41 and the client 11 that carries the client tracking unit 13. The wireless portable monitoring device 40 permits voice-activated and web-based tracking of one or more clients 11 by the monitoring individual 41.

Another aspect provides for an offender management system 10 having a central computer 20 that is ported to a plurality of software interfaces, including RF, GPS and integrated voice recognition, and that employs a wireless portable monitoring device 40 that is used by a monitoring individual 41 to interface to and remotely manage monitored clients 11 by way of the respective interfaces.

Another aspect provides for a two-piece transmitter 12 that allows the portion of the transmitter 12 that comes in direct contact with the skin of a client 11 to be discarded after each client 11 completes a monitoring term, thus improving the hygienic conditions for the client 11 and installer.

Another aspect provides for a monitoring unit 14 that provides for substantially simultaneous redundant dual frequency signal recognition and reception.

Another aspect provides for a client tracking unit 13 carried by a client 11 that is able to download location data to the central monitoring station 20 via a land line attached to the monitoring unit 14, and in addition, download location data using GSM/SMS messaging in the event of a land line failure.

Another aspect provides for a client tracking unit 13 that provides for GPS tracking, wireless voice and data receipt and relay, text message display, RF connection to the ankle transmitter 12, or docked connection to a monitoring unit, along with software intelligence and memory capabilities that permit such capabilities.

Another aspect provides for a dock that interfaces the monitoring unit 14 to the client tracking unit 13 which is charged by the monitoring unit 14, provides serial connection to the monitoring unit 14 for land line download of location and event data, allows the monitoring unit 14 to utilize the client tracking unit 13 for wireless download of RF information in the event of land line interruption to the monitoring unit 14, and disables the RF receiver 46 of the client tracking unit 13 when it is docked.

Another aspect provides for a monitoring center 20 that uses multiple offender tracking technologies monitored on a 24 hours, 7 days a week basis with output combined using a web server 33 and presented to a monitoring individual 41 by way of multiple devices, including PDA, cell phone, fax, computer email and the like. The present invention provides for the use of integrated voice response technology, radio frequency ankle bracelet technology, and multiple-level GPS technology delivered to the wireless portable monitoring device 40 that displays status of an entire population of monitored clients 11 regardless of the monitoring technology that is employed.

Another aspect comprises a wireless portable monitoring device 40 that provides for direct, real time, wireless voice and data access to both the monitored client 11 and the monitoring center 20. The wireless portable monitoring device 40 also alerts the monitoring client 41 using messages derived from the client tracking (GPS) and monitoring units 13, 14 using wireless technology, in real time, allows placement and receipt of calls directly between the monitoring center 20 and monitored client 11 and the monitoring individual 41 and monitored client 11, or that sends and receives data transmissions via a wireless connection.

Another aspect provides for an electronic monitoring system that uses a portable monitoring device 40 that allows the monitoring individual 41 to change the schedule of a client 11, view activity, view violation history, locate clients 11 (GPS), call clients 11, or view the status of clients 11.

Another aspect provides for an electronic monitoring system 10 that may be in a domestic violence application, that employs a wireless portable monitoring device 40 (offender monitoring device) for use by a victim that allows the victim to locate the offender's location in real time to reduce or preclude unintended collateral contact, or that allows the victim to have data and voice contact with the monitoring center 20 to gain assistance or to a monitoring individual 40 if permitted by agency requirements.

Yet another aspect provides for a field verification unit 80 that is used by the monitoring individual 41 to perform "drive-by" monitoring (remote monitoring) of clients 11. The field verification unit 80 monitors transmissions from any transmitter within its range to verify the location of clients 11 wearing the transmitters 12.

Thus, improved electronic monitoring systems and methods have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An electronic monitoring system for monitoring a client, comprising:

a transmitter worn by the client that transmits status data regarding status of the transmitter at one or more predetermined frequencies;

a client tracking unit carried by the client that comprises a wireless voice and data communication device, a receiver that receives the status data transmitted by the transmitter, a GPS (Global Positioning System) receiver that receives time-coded position data derived from satellites of the Global Positioning System that indicate the geolocation of the client tracking unit over time, and a memory that stores the time-coded position data;

a monitoring center for receiving and storing the status data and GPS data derived from the client tracking unit in a database, and a web server communicating with the database;

a wireless portable monitoring device carried by a monitoring individual not located at the monitoring center and who is tasked with monitoring the client that comprises a wireless voice and data communication device, and a web browser that communicates with the database by way of the web server to selectively access data regarding the client to remotely monitor the client to track the location of the client over time; and a wireless communication link for communicating between the portable monitoring device, the client tracking unit, and the monitoring center.

2. The system recited in claim 1 further comprising:

a monitoring unit for use by the client that comprises a receiver for receiving the data transmitted by the transmitter when it is in proximity thereof, and communication apparatus for downloading the data to the monitoring center.

3. The system recited in claim 2 further comprising:

a dock in communication with the monitoring unit that docks the client tracking unit and wherein the monitoring unit transmits the time-coded position information stored in the client tracking unit to the monitoring center by way of land communication lines when the client tracking unit is docked.

4. The system recited in claim 3 wherein the receiver of the client tracking unit has a first reception range relative to the transmitter, the dock comprises means for turning off the receiver of the client tracking unit when it is docked, and wherein the receiver of the monitoring unit has a second, extended reception range relative to the transmitter.

5. The system recited in claim 2 further comprising:

a dock in communication with the monitoring unit that docks the client tracking unit and wherein the monitoring unit wirelessly transmits the time-coded position data stored in the client tracking unit to the monitoring center using SMS (Short Message Service) messages by way of the wireless communication link to the monitoring center when it is docked with the monitoring unit and when the landline communication link therebetween is inoperative.

6. The system recited in claim 1 wherein the receiver in the client tracking unit receives the predetermined data over first and second predetermined frequencies transmitted by the transmitter.

7. The system recited in claim 2 wherein the receiver in the monitoring unit receives the predetermined data over first and second predetermined frequencies transmitted by the transmitter.

8. The system recited in claim 1 further comprising a field verification unit coupled to the wireless portable monitoring device that comprises one or more receivers that receive the data transmitted by the transmitter so as to remotely monitoring clients whose transmitters are within its range.

9. The system recited in claim 1 wherein the transmitter comprises:

a strap;

a transmitter housing enclosing transmitter electronics and a battery; and a snap-on base plate having a surface that comes in direct contact with skin of the client after installation, which base plate engages the strap and mates with the transmitter housing to lock the housing strap and base plate together.

10. The system recited in claim 9 wherein the snap-on base plate is disposable.

11. The system recited in claim 1 wherein the client tracking unit comprises software that monitors and reports transmitter proximity, monitors and reports strap status, and monitors and reports transmitter battery status.

12. The system recited in claim 1 wherein the memory of the client tracking unit stores restricted zone points, contact names and telephone numbers, and changeable transmitter identification data.

13. The system recited in claim 1 wherein the client tracking unit comprises a GSM (Global System for Mobile) capable cellular communication device that permits selective voice contact between the client and the monitoring center and the monitoring individual.

14. The system recited in claim 1 wherein the client tracking unit comprises software that selectively displays SMS (Short Message Service) messages to the client corresponding to text messages, schedule reminders, zone awareness reminders, and contact reminders.

15. The system recited in claim 1 wherein the client tracking unit comprises software that displays SMS (Short Message Service) messages transmitted from the monitoring individual and monitoring center.

16. The system recited in claim 1 wherein the wireless portable monitoring device alerts the monitoring individual in response to messages derived from the client tracking and monitoring units using the wireless communication link.

17. The system recited in claim 1 wherein the wireless portable monitoring device is operative to place calls to and receive calls from the monitoring center and to place calls to and receive calls from the client tracking unit.

18. The system recited in claim 1 wherein the monitoring center comprises GPS and RF processors for processing the status data and GPS data derived from the client tracking unit and whose outputs are integrated by the web server and wirelessly delivered to the monitoring individual on the portable monitoring device.

19. The system recited in claim 1 wherein the monitoring center comprises an integrated voice response processor, a radio frequency processor, and a multi-level GPS processor, and wherein outputs of the respective processors are integrated by the web server and wirelessly delivered to the wireless portable monitoring device to display information regarding the client.

20. The system recited in claim 1 wherein the wireless portable monitoring device comprises a victim's wireless portable monitoring device for use by a victim that communicates with the database by way of the web server to display the location of a particular client in real time.

21. The system recited in claim 1 that further comprises a victim's wireless portable monitoring device for use by a victim that comprises a wireless voice and data communication device and web browser that communicates with the database by way of the web server to display the location of a particular client in real time.

22. The system recited in claim 20 wherein the victim's wireless portable monitoring device allows the victim to have selective data and voice contact with operators at the monitoring center or monitoring individual.

23. A method of electronically monitoring a client, comprising the steps of:

transmitting signals containing data regarding a body-worn transmitter worn by a client;

receiving and storing the signals transmitted by the transmitter in a wireless voice and data communication device carried by the client;

receiving and storing time-coded position information in the wireless voice and data communication device that indicates the geolocation thereof;

transmitting the data regarding the body-worn transmitter worn by the client and the time-coded position information regarding the client to a monitoring center;

storing the data regarding a body-worn transmitter and the time-coded position information in a central database; and remotely accessing the central database to access and review the data and time-coded position information relating to the client to monitor the client.

24. The method recited in claim 23 wherein the accessing step comprises the step of:

remotely and wirelessly accessing the central database to access and review the data and time-coded position information relating to the client to monitor the client.

25. The method recited in claim 23 wherein the accessing step comprises the step of:

initiating a web browsing session on a portable wireless monitoring device that interfaces to the central database by way of a web server to access and review the data and information relating to the client.

26. The method recited in claim 23 wherein the transmitting step comprises the steps of:

docking the wireless voice and data communication device to a monitoring unit; and transmitting data and time-coded position information relating to the client to the monitoring center by way of land communication lines.

27. The method recited in claim 23 wherein the transmitting step comprises the steps of:

docking the wireless voice and data communication device to a monitoring unit; and transmitting data and time-coded position information relating to the client to the monitoring center using SMS (Short Message Service) messages over a wireless communication link.

28. The method recited in claim 23 wherein the transmitting step transmits signals at two different frequencies separated in time.

29. The method recited in claim 23 wherein the accessing step comprises the step of:

transmitting voice commands to the monitoring center using a portable wireless monitoring device that interfaces to the central database by way of web server and VXML interfaces to access and review the data and information relating to the client.

30. A method of electronically monitoring a client, comprising the steps of:

providing the client with a wireless voice and data communication device having a GPS receiver and memory that stores time-coded position data corresponding to the location of the device derived from GPS satellites, and that comprises a receiver that receives signals from a body-worn transmitter comprising transmitter data that indicate the substantial collocation of the wireless communication device and the transmitter;

transferring the time-coded position data and the transmitter data from the wireless communication device to a central database that stores data regarding the client; and remotely accessing the central database to access and review the time-coded position data and the transmitter data relating to the client to monitor the client.

31. The method recited in claim 30 wherein the transferring data step comprises the steps of:

transferring the time-coded position data and the transmitter data from the wireless communication device to a monitoring unit; and transferring the time-coded position data and the transmitter data from the monitoring unit to the central database.

32. The method recited in claim 30 wherein the accessing step comprises the step of:

remotely and wirelessly accessing the central database to access and review the time-coded position data and the transmitter data relating to the client to monitor the client.

33. The method recited in claim 31 wherein the step of transferring data to the monitoring unit comprises transferring substantially the same data at two different frequencies separated in time to the monitoring unit.

34. The method recited in claim 30 wherein the accessing step comprises the step of:

transmitting voice commands using a remote monitoring device that interfaces to the central database by way of web server and VXML interfaces to access and review the data and information relating to the client.

35. The method recited in claim 30 wherein the accessing step comprises the step of:

transmitting voice commands using a wireless monitoring device that interfaces to the central database by way of web server and VXML interfaces to access and review the data and information relating to the client.

36. An electronic monitoring system for monitoring a client, comprising:

a transmitter that transmits status data regarding status of the transmitter;

a client tracking unit that comprises a GPS-enabled wireless voice and data communication device that receives time-coded position data derived from satellites of the Global Positioning System, and a memory that stores the time-coded position data, client tracking unit is in communication with the transmitter;

a wireless communication link; and a wireless portable monitoring device that comprises a wireless voice and data communication device, for communicating with the client tracking unit by way of the wireless communication link to remotely monitor the client.

37. An electronic monitoring system for monitoring a client, comprising:

a transmitter that transmits status data regarding status of the transmitter;

a client tracking unit comprising a GPS-enabled wireless voice and data communication device that is in communication with the transmitter that receives time-coded position data derived from satellites of the Global Positioning System, and a memory that stores the time-coded position data, and, which client tracking unit communicates the status data and GPS location data relating to the client to the monitoring center for storage;

a monitoring center for storing status data and GPS location data relating to the client;

a wireless communication link; and a wireless portable monitoring device for communicating with the monitoring center by way of the wireless communication link to remotely monitor the client.

38. A method of electronically monitoring a client, comprising the steps of:

providing the client with a client tracking unit comprising a GPS-enabled wireless voice and data communication device that receives time-coded position data derived from satellites of the Global Positioning System, and a memory that stores the time-coded position data, and that is in communication with a body-worn transmitter;

providing a monitoring individual tasked with monitoring the client with a wireless portable voice and data communication device; and communicating between the client tracking unit and wireless portable voice and data communication device to remotely monitor the client.

39. The method recited in claim 38 further comprising the steps of:

transferring data derived from the client tracking unit device and the body-worn transmitter to a central database; and remotely accessing the central database from the wireless portable voice and data communication device to review the data relating to the client and thus monitor the client.

40. The method recited in claim 39 wherein the step of remotely accessing the central database comprising the step of:

wirelessly communicating between the wireless portable voice and data communication device and the database using a web browser and a web server.

41. Apparatus for monitoring a client, comprising:

a transmitter worn by the client that transmits status data regarding status of the transmitter at one or more predetermined frequencies; and a client tracking unit carried by the client comprising a wireless voice and data communication device, and a receiver that receives the status data transmitted by the transmitter, a GPS (Global Positioning System) receiver that receives time-coded position data derived from satellites of the Global Positioning System that indicate the geolocation of the client tracking unit over time, and a memory that stores the time-coded position data.

42. The apparatus recited in claim 41 wherein the client tracking unit receives the predetermined data over first and second predetermined frequencies transmitted by the transmitter.

* * * * *